US005638097A

United States Patent [19]

Takayanagi et al.

[11] Patent Number: 5,638,097

[45] Date of Patent: Jun. 10, 1997

[54] RECORDING APPARATUS TO WHICH RECORDING HEAD IS DETACHABLY MOUNTED

[75] Inventors: Yoshiaki Takayanagi; Asao Saito; Ryoichi Koizumi; Hirokazu Ikeda, all of Yokohama, Japan

[73] Assignee: Canon Kabushiki Kaisha, Tokyo, Japan

[21] Appl. No.: 131,409

[22] Filed: Oct. 4, 1993

Related U.S. Application Data

[63] Continuation of Ser. No. 451,509, Dec. 15, 1989, abandoned.

[30] Foreign Application Priority Data

| | | | |
|---|---|---|---|
| Dec. 16, 1988 | [JP] | Japan | 63-316431 |
| Dec. 16, 1988 | [JP] | Japan | 63-316432 |
| Dec. 20, 1988 | [JP] | Japan | 63-321507 |
| Dec. 20, 1988 | [JP] | Japan | 63-321508 |
| Dec. 20, 1988 | [JP] | Japan | 63-321509 |
| Jan. 28, 1989 | [JP] | Japan | 1-018244 |
| Mar. 30, 1989 | [JP] | Japan | 1-080001 |

[51] Int. Cl.[6] ..... B41J 2/05

[52] U.S. Cl. ..... 347/7; 347/14; 347/17; 347/19; 347/49

[58] Field of Search ..... 347/19, 17, 14, 347/49, 7; 400/175

[56] References Cited

U.S. PATENT DOCUMENTS

| | | | |
|---|---|---|---|
| 3,971,039 | 7/1976 | Takano et al. | 346/346 |
| 4,269,161 | 5/1981 | Simmons . | |
| 4,386,862 | 6/1983 | Kittel | 400/175 X |
| 4,396,923 | 8/1983 | Noda | 347/14 X |
| 4,429,321 | 1/1984 | Matsumoto | 347/59 |
| 4,703,332 | 10/1987 | Crotti et al. | 346/140 |
| 4,712,172 | 12/1987 | Kiyohara et al. | 347/62 |
| 4,719,475 | 1/1988 | Kiyohara | 347/7 X |
| 4,741,634 | 5/1988 | Nozaki et al. | 400/120 |
| 4,778,291 | 10/1988 | Mitsuhashi | 400/121 |
| 4,788,861 | 12/1988 | Lichti | 73/304 R |
| 4,803,500 | 2/1989 | Milbrandt | 346/140 R |
| 4,860,034 | 8/1989 | Watanabe | 347/14 |
| 4,872,027 | 10/1989 | Buskirk | 347/19 X |
| 5,235,351 | 8/1993 | Koizumi | 347/19 X |

FOREIGN PATENT DOCUMENTS

| | | | |
|---|---|---|---|
| 0255867 | 7/1987 | European Pat. Off. . | |
| 60-2370 | 1/1985 | Japan | B41J 3/04 |
| 62-77947 | 4/1987 | Japan | B41J 3/04 |
| 1524024 | 9/1978 | United Kingdom . | |
| 1578031 | 10/1980 | United Kingdom . | |

OTHER PUBLICATIONS

Lonis, Robert A.; Storage of Operating Parameters in Memory Integral with Printhead, Xerox Disc. J. VSNG Nov. 12, 1983 p. 503.

*Primary Examiner*—Joseph W. Hartary

*Attorney, Agent, or Firm*—Fitzpatrick, Cella, Harper & Scinto

[57] ABSTRACT

A recording apparatus has a recording operation that is performed after a disposable liquid ejection recording head is mounted. The discrimination is made as to whether the recording head mounted is proper or not relative to the main assembly to which the recording head is mounted, when the main switch is actuated or the recording head is mounted. The discrimination is made with use of a part of a structure in the recording head: a temperature sensor, a temperature keeping heater, an ejection heater or a driving semiconductor function element, for example. If it is not proper, the recording operation is prevented, and/or the improperness is displayed.

30 Claims, 26 Drawing Sheets

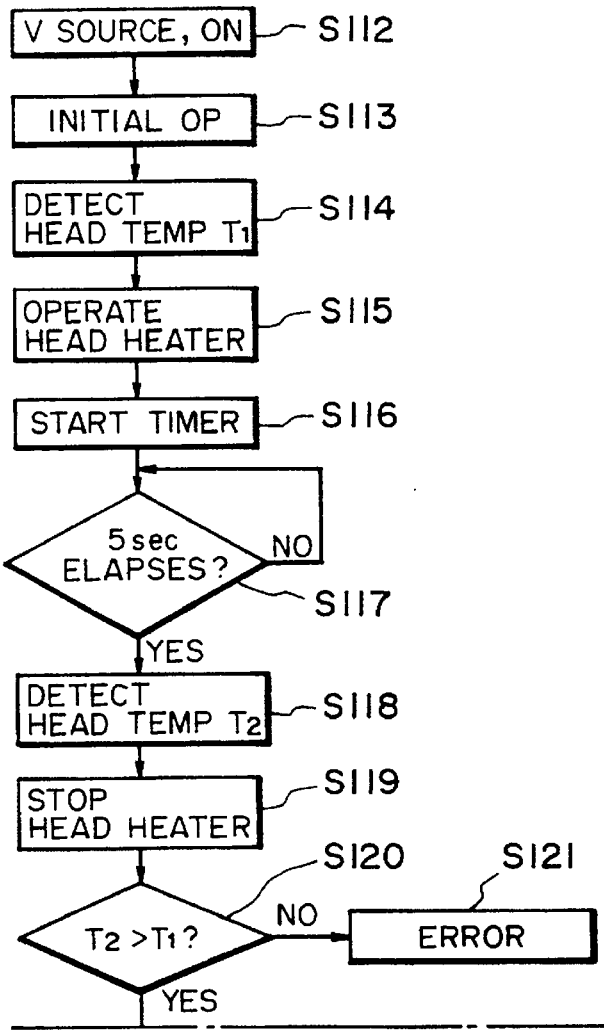
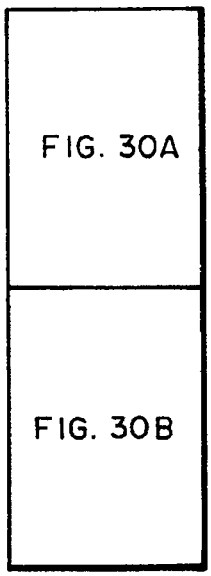
FIG. 30
FIG. 30A

RECORDING APPARATUS TO WHICH RECORDING HEAD IS DETACHABLY MOUNTED

This application is a continuation of application Ser. No. 07/451,509 filed Dec. 15, 1989, now abandoned.

FIELD OF THE INVENTION AND RELATED ART

The present invention relates to a recording apparatus to which a recording head is detachably mountable, more particularly to a liquid jet recording apparatus and a recording head therefor which uses an electric thermal transducer as liquid energy generating means for ejecting droplets for the recording.

The liquid jet recording head is noteworthy because the recording density can be easily increased, because the mass-production is easy and because the manufacturing cost is not high. These attributes result from the features that liquid jet recording outlets such as orifices or the like for ejecting the recording liquid (ink) droplet can be arranged at a high density so that high resolution printing is possible, that the entire size of the recording head can be easily reduced, that the semiconductor manufacturing technology (IC) and/or a micro-processing technique which are remarkably improved recently in the reliability can be used to good advantages, and that it is easy to manufacture an elongated head or a two-dimensional head.

Along with the demand tendency for the low cost, a disposable recording head or a recording head cartridge having a recording head and an ink container for supplying ink to the recording head, as a unit, have been proposed to facilitate the mounting and dismounting operation relative to the main assembly of the apparatus. This is advantageous in that the failure or the like of the recording head can be easily recovered, and in that the ink can be easily replenished in the cartridge type recording head. It follows that the maintenance and servicing operations for the apparatus can be omitted or simplified.

When the disposable recording head or the head cartridge is mounted into the main assembly, it is general that the electric contacts in the form of connectors provided in the head or head cartridge and the main assembly are connected to provide the electric connection therebetween. By the electric connection, the driving signals can be transmitted from the control system of the main assembly to the electrothermal transducer of the recording head, and in addition, various parameters of the recording head or the head cartridge can be transmitted to the main assembly.

In consideration of making the recording head or cartridge exchanging operation easier, it is desirable that the structures of the mechanical and electric connections of the recording head or the cartridge and the main assembly of the apparatus are simplified. Then, there occurs a liability that the recording head or the head cartridge which is not proper for the main assembly is mounted to the main assembly. For example, the control system of the main assembly may be constructed in accordance with the number of the electrothermal transducers (number of dots) of the recording head to be used; or the energy of the driving signal (driving voltage and/or pulse width) is determined in consideration of the property of the ink or the like to be used. Therefore, the recording head not matching the main assembly is liable to be erroneously mounted.

If the recording operation is performed with the improper recording head mounted, the recorded image quality is degraded. However, it is not until the start of the recording operation that the operator notes the mounting of the erroneous recording head. Even if such a remarkable degrading of the record does not result, or if it is overlooked, the control system or the recording head may be adversely influenced. Particularly, since the liquid jet recording apparatus using the electrothermal transducers as the ejection energy generating elements, consumes a large current, it can not be completely denied that there occurs a dangerous situation.

Even if the proper head or head cartridge is mounted, the individual head or head cartridges are different in some property because of the variation in the manufacturing process, the change with time and the situation where the head is kept stored, and the variations may be accumulated with the result of such variations as is influential to the operational properties of the recording head. This can result in degrading of the image recorded and/or apparatus failure.

SUMMARY OF THE INVENTION

Accordingly, it is a principal object of the present invention to provide a recording apparatus in which the degrading of the image quality or the adverse affect to the apparatus can be prevented when an improper recording head is mounted into the apparatus.

It is another object of the present invention to provide a recording apparatus wherein the properness of the recording head mounted is discriminated using a part of a structure of the recording head.

It is a further object of the present invention to provide a recording apparatus wherein the properness of the recording head mounted is discriminated, and if it is not proper, the start of the recording operation is prohibited.

It is a further object of the present invention to provide a liquid jet recording apparatus wherein when improper recording liquid is supplied, and the event is detected, the recording operation is prohibited, so that the degrading of the record and the clogging of the recording head is prevented.

It is a further object of the present invention to provide a liquid jet recording apparatus wherein the properness of the recording head mounted is discriminated by inspecting the operational properties of a temperature keeping heater and a temperature sensor which remarkably represents the properties of the individual heads.

It is a further object of the present invention to provide a liquid Jet recording head wherein the properness of the recording head mounted is discriminated by inspecting the operational property of a function element disposed to selectively drive the ejection energy generating elements, which is a part remarkably representing the properties of the individual recording heads.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 30, 30A, 30B, 31, 31A and 31B are flow charts illustrating the operational steps of the control system of FIG. 29.

DETAILED DESCRIPTION OF THE PREFERRED EMBODIMENTS

Figure 1:
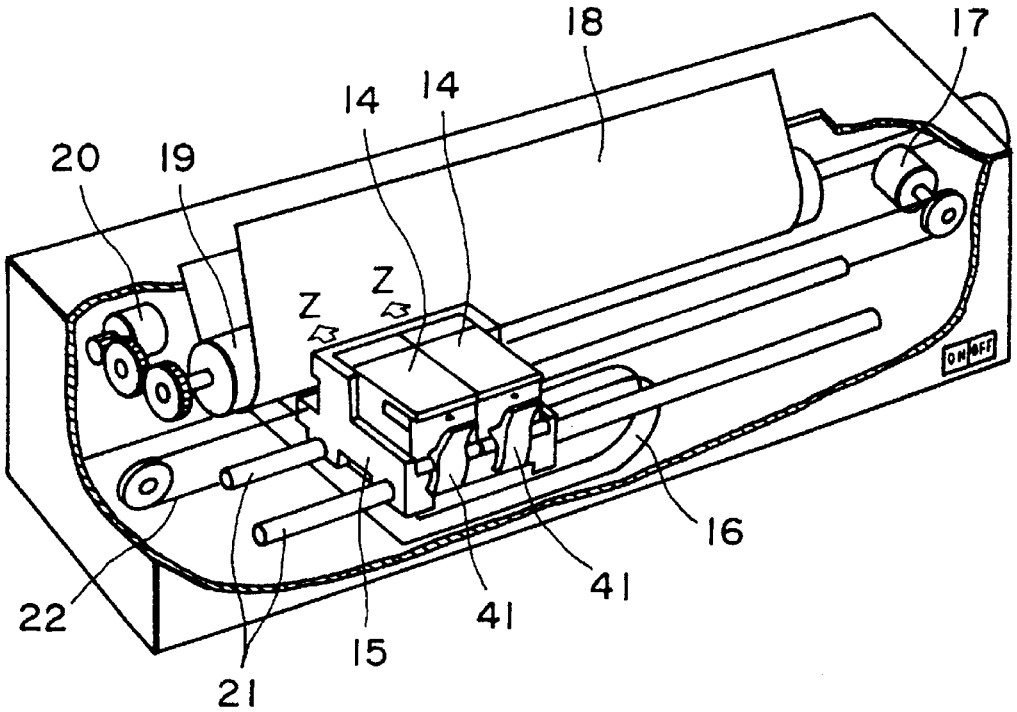
FIG. 1 is a perspective view of an exemplary ink jet recording apparatus according to an embodiment of the present invention.
Figure 2:
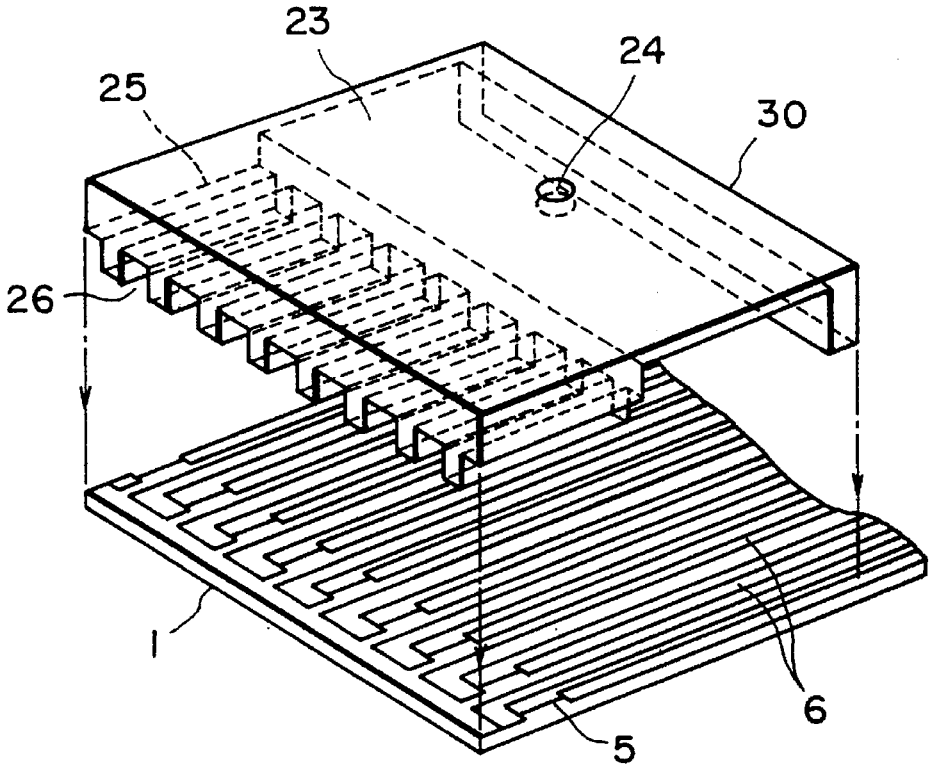
FIG. 2 is a perspective view of an example of a recording head used with FIG. 1 apparatus.
Figure 3A:
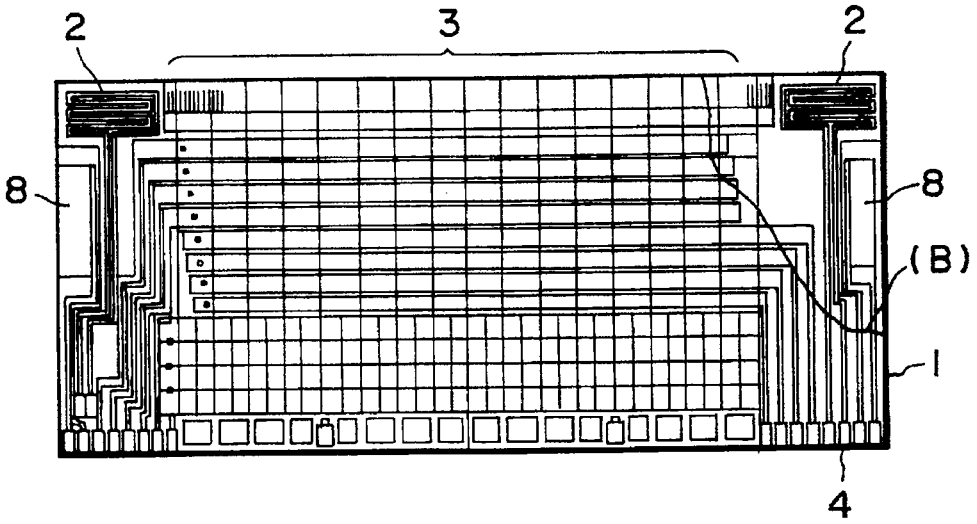
FIGS. 3A and 3B are top plan view and a partial enlarged view of an example of a heater board usable with the recording head shown in FIG. 2.
Figure 3B:
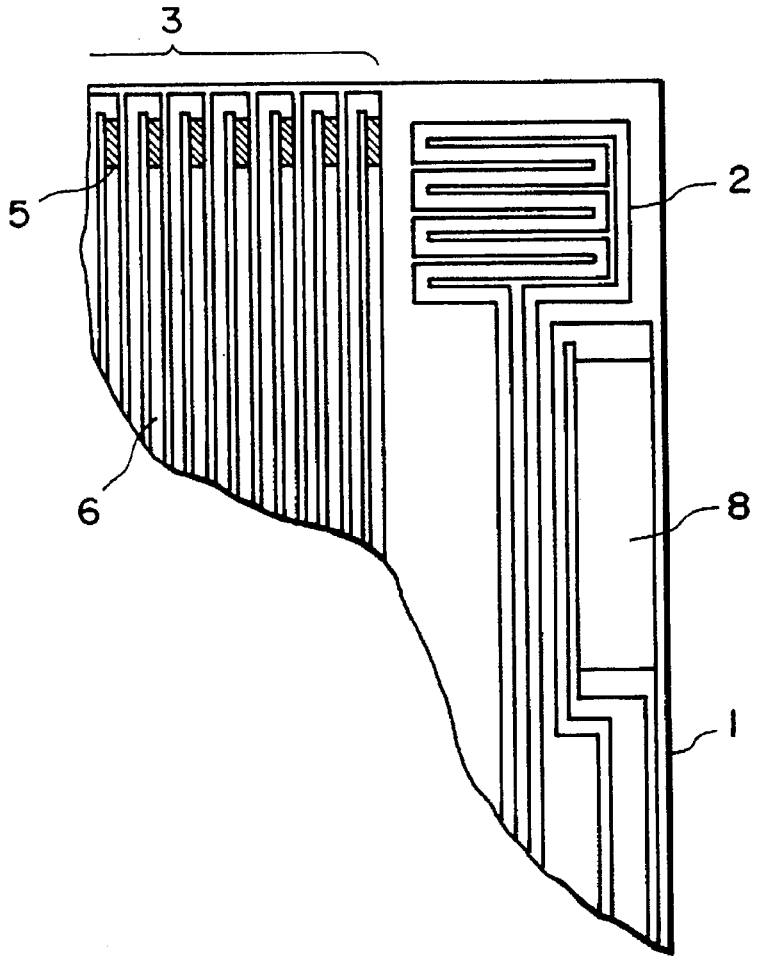

Referring to FIG. 1, there is shown an exemplary liquid jet recording apparatus according to a first embodiment of the present invention. FIG. 2 shows the structure of the recording head used with the apparatus of FIG. 1. FIGS. 3A and 3B show a structure of a heater board usable with the recording head of FIG. 2.

In FIG. 1, a head cartridge 14 includes a recording head chip and an ink container for supplying ink thereto, as a unit, and includes a heater board which will be described hereinafter in conjunction with FIGS. 2 and 3. The head cartridge 14 is fixedly mounted on a carriage 15 by a confining member 41. The carriage 15 is movable along the length of the shaft 21 together with the head cartridge 14. The ink ejected through the ejection outlet of the recording head chip reaches a recording medium 18 which is disposed away from the ejection outlet with a small clearance on a platen 19 which is effective to confine the recording surface of the medium. By the ink, an image is formed on the recording medium 18.

To the ejection energy generating elements of the recording head chip, ejection signals are supplied in accordance with the image data to be recorded from a proper data source through a cable 16 and through connectors 4 (FIG. 3) connected thereto. Corresponding to the number of colors of the ink, one or more (two in this Figure) of the head cartridges are usable.

In FIG. 1, a carriage motor 17 functions to scanningly move the carriage 15 along the shaft 21. The driving force is transmitted by a wire 22 from the motor 17 to the carriage 15. The recording medium 18 is fed by a feed motor 20 operatively associated with the platen roller 19.

FIG. 2 shows an example of a structure of the recording chip used in this embodiment. It includes a heater board 1, which comprises a silicone substrate, electrothermal transducers (ejection heater) 5 and wiring 6 made of aluminum or the like for supplying the electric power thereto. They are formed by fine film forming technique. The recording head chip is constructed by bonding a top plate 30 provided with partitions for forming recording liquid passages (nozzles) 25, onto the heater board 1.

The liquid (ink) for the recording is supplied to a common chamber 23 through a supply port 24 formed in the top plate, and it is introduced into the nozzles from the common chamber 23. When the heater 5 generates heat by the electric energization, a bubble is formed in the ink filled in the nozzle 29, upon which a droplet of the ink is ejected through the ejection outlet 26.

FIGS. 3A and 3B are a top plan view and an enlarged view of the heater board used in this embodiment.

As shown in FIG. 3A, the heater boards includes the silicone substrate having built-in energy generating elements and an ejection heater portion 3 functioning as an ejection energy producing element. Contacts 4 are connected with an external device by wiring bonding. A temperature sensor 2 functioning as the temperature detecting means is formed in the ejection heater portion 3, and is produced by the same thin film forming process as the ejection heater portion 3. FIG. 3B is an enlarged view of a portion B including the sensor 2 in FIG. 3A. Designated by a reference 8 is a temperature keeping heater functioning as heating means for heating the head.

The sensor 2 is formed by a thin film forming process as in the semiconductor manufacturing, similarly to the other portions, and therefore, the precision thereof is very high. It may be made of a material having an electric conductivity different in accordance with the temperature, and the material thereof may be the same as a structure material of the other parts, such as aluminum, titanium, tantalum, tantalum pentoxide, niobium or the like. Of these materials, aluminum is usable for the electrodes; titanium may be used between a heat generating layer constituting the electrothermal transducer and an electrode therefor to improve the bonding property; and tantalum may be used to improve an anti-cavitation property of the protection layer on the heat generating resistor layer. In this apparatus, in order to reduce the variation of the processing, the width of the lines are increased, and in order to reduce the influence of the wiring resistance or the like, the meander structure is used to increase the electric resistance.

Similarly, the temperature keeping heater 8 may be made of the same material as the heat generating resistance layer of the ejection heater 5 ($HfB_2$, for example), but it may be made of another material constituting the heater board, such as aluminum, tantalum or titanium.

In the recording head of FIG. 2, the temperature sensors 2 are disposed adjacent opposite ends of the heater board 1, as shown in FIG. 3. Therefore, the temperature distribution of the substrate in the direction of the arrangement of the nozzles 25 can be known from the output of the temperature sensors. Since the temperature keeping heater 8 is disposed in the vicinity of the temperature sensors 2, the response for detecting the temperature change by the heat is quick. Using this, the temperature control for maintaining a constant temperature distribution on the board can be performed with quick response and with good reliability.

In this embodiment, the temperature control system for such a temperature control, is also used as a circuit for discriminating whether the head cartridge matching the recording apparatus is mounted thereto or not.

Figure 4:
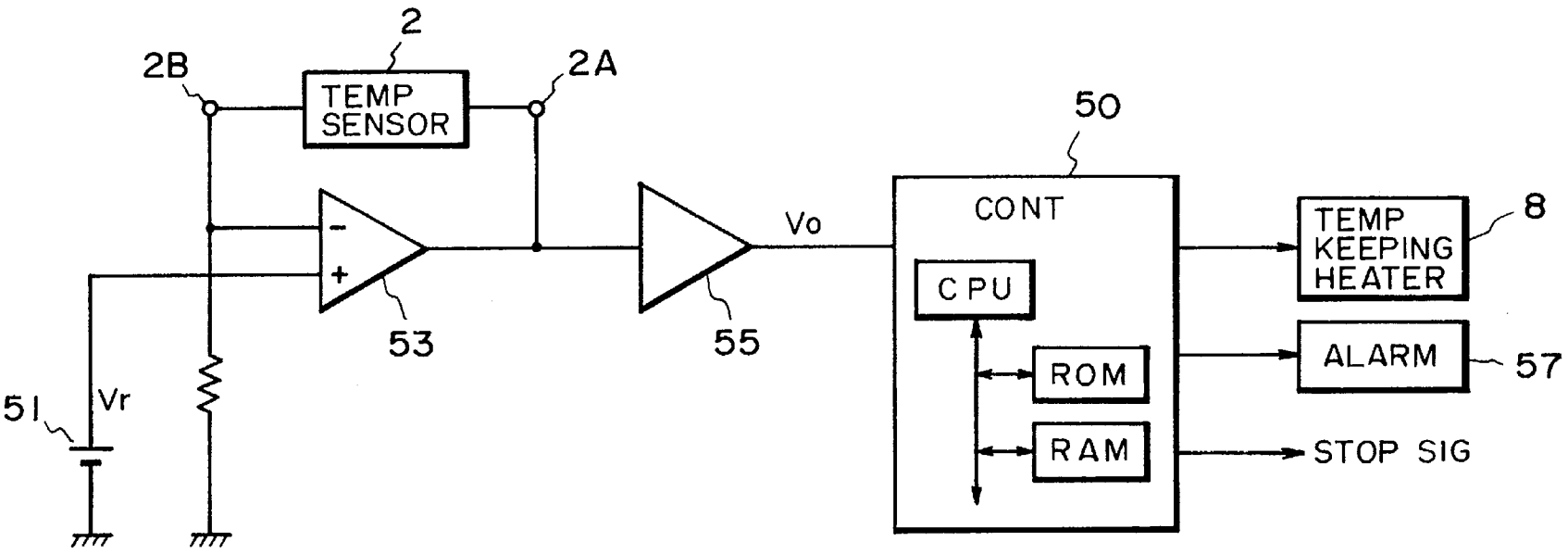
FIG. 4 is a block diagram of an example of a control system for temperature control and for discriminating the properness of the recording head.

FIG. 4 shows an example of the temperature control system. In this Figure, the control device 50 has a CPU (central processing unit) for executing the sequential operational steps which will be described hereinafter in conjunction with FIG. 5, ROM for storing fixed data such as a program or programs for the sequential steps, and RAM for the operations. The control device 50 may be contained in the main control system of the apparatus shown in FIG. 1.

A voltage source 51 produces a reference voltage Vr. An operational amplifier 53 has a positive terminal to which the reference voltage Vr is supplied from the voltage source 51 and a negative terminal to which a fed-back voltage through the temperature sensor 2 is supplied. An amplifier 55 amplifies the output of the operational amplifier 53 and supplies the output Vo to the control device 50. Designated by references 2A and 2B are contacts in the feed-back passage. When the recording head chip or the head cartridge 14 provided with a heater board 1 described in conjunction with FIGS. 3A and 3B, is mounted in the apparatus, a feedback circuit including the temperature sensor 2 is constituted. A warning device 57 may include a display made of LED or the like, a sound making device such as buzzer or the like or a combination thereof.

Figure 5:
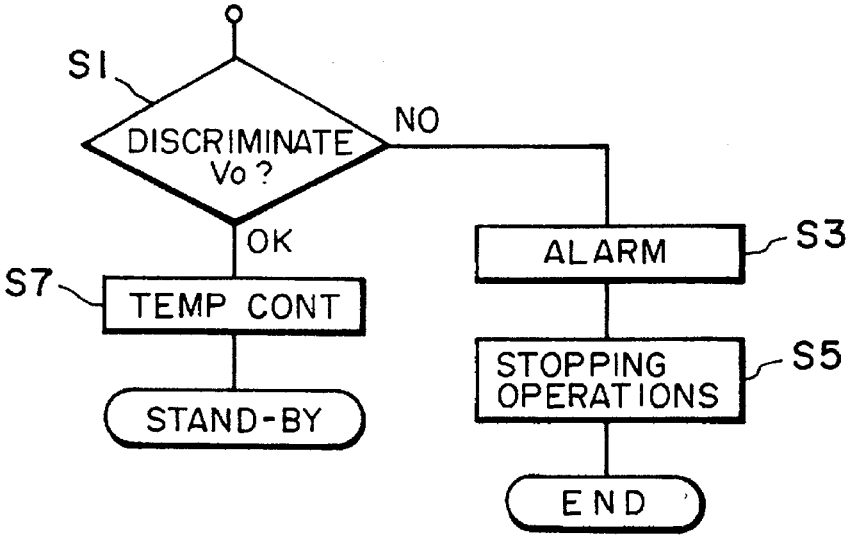
FIG. 5 is a flow chart showing an example of sequential control.

FIG. 5 shows an example of the operational steps using the control system described above. This sequential operations can be performed immediately after the main switch of the apparatus is closed, or when the exchange of the head cartridge 14 is detected.

When the operation is started, the level of Vo is first detected at step S1. At this time, the contacts 2A and 2B are open when the head cartridge 14 is not yet mounted, when it is incompletely mounted or when it is not provided with a temperature sensor 2 (in other words, the cartridge is not proper for the apparatus). Therefore, the voltage Vo is the reference voltage Vr multiplied by the amplification of the amplifiers 53 and 55. Then, step S3 is executed, upon which the non-mounting or the improper mounting is informed to the operator by driving the warning device 57, and simultaneously, a stop signal is produced at step S5 to prohibit the recording operation.

When, on the other hand, the correct head cartridge 14 having the recording head chip provided with the temperature sensors 2 shown in FIG. 3 is mounted in place, a feed-back loop containing the temperature sensor between the contacts 2A and 2B is constituted. Therefore, the temperature keeping heater 8 is properly controlled using the voltage Vo to be prepared for the recording operation.

In this embodiment, the temperature sensor 2 may be in the form of a thermistor, a diode, a transistor or the like. It may be formed on the heater board 1 simultaneously with the ejection heater 5 or the like, or it may be formed separately. Or, it may not be formed on the heater board 1, and a proper number of the sensors may be disposed at proper positions of the recording head.

Even if the recording head or the head cartridge is provided with the temperature sensor 2, the sensor may be out of use depending on the main assembly with which the recording head or the head cartridge is used, the temperature sensor 2 is modifiable depending on the make-up of the main assembly of the apparatus. For example, when the thermistor is used, the property curve thereof is made different depending on the make-up of the apparatus, by which the properness of the mounting is discriminated for the individual make-up. For example, the ambient temperature may be inputted into the main assembly, and the properness of the recording head can be discriminated by comparing the detected voltage Vo and the voltage Vo to be provided at the temperature.

In this embodiment, two temperature sensors 2 are employed. The discrimination of the properness of the recording head may be made using only one of them, or it may be made using both of them, in which case the recording head or the head cartridge 14 is discriminated as being proper when both satisfy the predetermined requirements.

Figure 6:
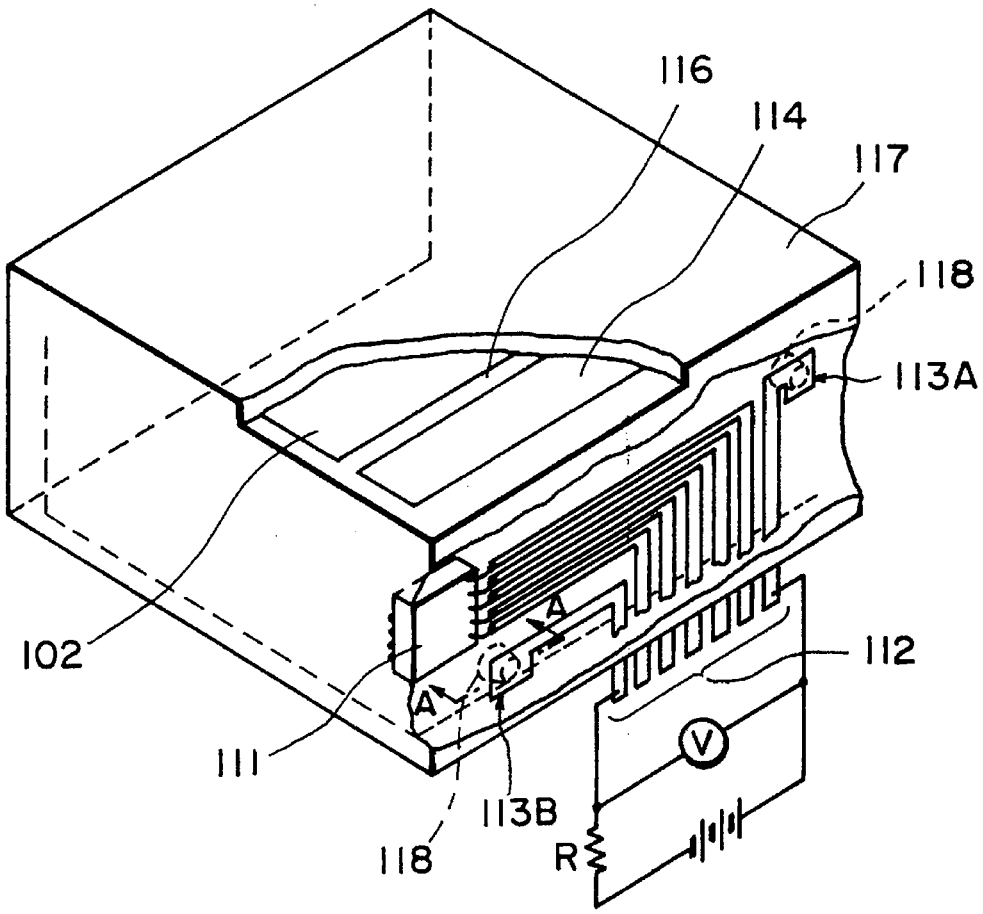
FIG. 6 is a perspective view of another example of the recording head.

Referring to FIG. 6, a second embodiment of the present invention will be described. The recording head of this embodiment comprises a recording head chip 111 having the same structure as shown in FIG. 2, wiring 112 (which will be called "lead frame") in the form of a conductive plate for providing electric connection between the recording head chip 111 and the main assembly of the liquid jet recording apparatus through wire bonding or the like, electrodes 113A and 113B for detecting remaining amount of the ink, which is built-in in the lead frame 112, an ink passage 114 for supplying the ink to the recording head chip 111 from an ink container 102 and a partition 116 between the ink container 102 and the ink supplying passage 114.

Figure 7:
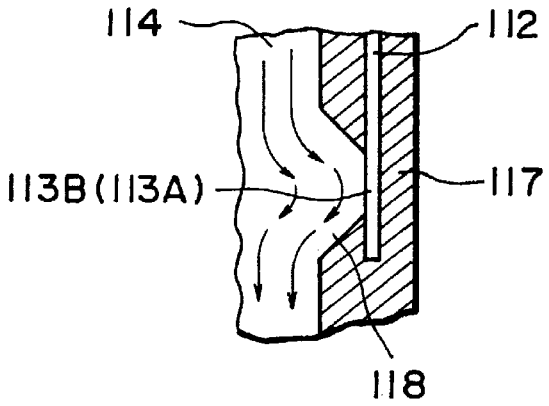
FIG. 7 is a cross-sectional taken along A—A in FIG. 6.

FIG. 7 shows an example of the structure of the detecting electrode. In this Figure, the lead frame 112 is embedded in a resin casing 117 of the head cartridge which is constituted by unified ink container 102 and recording chip 111. Only the remaining amount detecting electrodes 113A and 113B are exposed into the ink supply passage 114 through a conductor, and electric power is supplied between the electrode through a resistor R.

Figure 8:
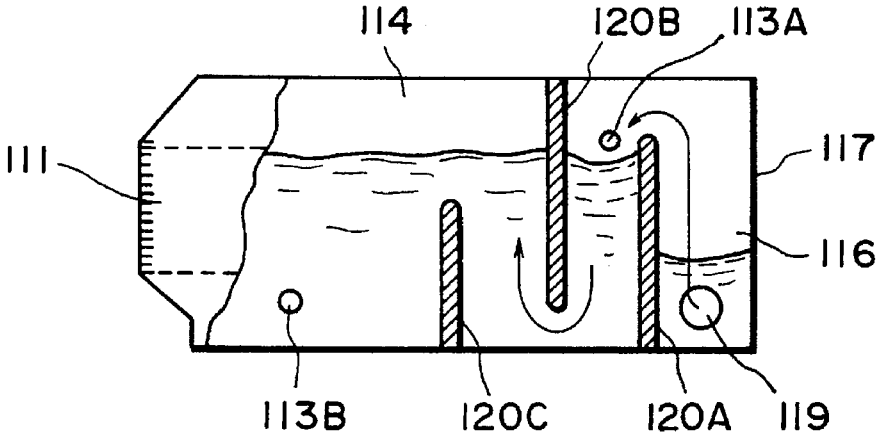
FIG. 8 schematically shows the structure of the ink supply passage of the recording head shown in FIG. 6.

As shown in FIG. 8, the ink supply passage 114 has an ink supply inlet 119 formed in the partition wall 116, and the ink supply passage 114 is provided with ribs 120A, 120B and 120C alternately extended from the bottom and top of the passage.

The ink supplied to the supply passage 114 through the ink supply inlet 119 from the ink container 102 is introduced into the next section beyond the first rib 120A by unshown capillary tube or tubes, and is supplied into the recording head chip 111 through the path indicated by an arrow. Then, the ink is ejected through the ejecting outlet 26 upon recording operation or the like. When the ink in the ink container 102 is used up, and therefore, the ink is not introduced into the ink supply passage 114, the surface of the liquid becomes as shown in FIG. 8, in which the ink remainder amount detecting portion 113A is exposed above the liquid surface, by which the electric connection between the detecting portions 113A and 113B is interrupted.

Figure 9:
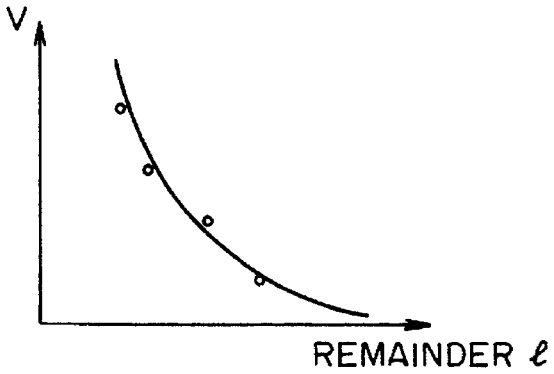
FIG. 9 is a graph showing a relation between a voltage and a removing amount of ink when a current flowing between two detecting electrodes is maintained constant.

By the detection of the disappearing of the electric current therebetween, the reaching of the ink remaining amount to the limit is detected. As long as thin layers of the ink which is conductive are remaining on the electric contacts, the electric current flows. Therefore, the detecting circuit is such that a constant current flows, the relationship between the voltage V and the remaining amount of the ink l is as shown in FIG. 9. Using this, the level of the amount of the remaining ink can be known.

In this embodiment, the control system for detecting the remaining amount of the ink is used also as a circuit for discriminating whether a proper head cartridge 14 is mounted or not.

The structure of the circuit is substantially the same as shown in FIG. 5, and the processing steps are the same as shown in FIG. 5 for performing the discrimination.

More particularly, when the head cartridge 14 is not mounted, when it is incompletely mounted, or when the head cartridge 14 is the one not provided with the remaining amount detecting electrodes 113A and 113B or the lead frame 112, the same voltage that indicates the absence of the ink appears, and in that case, the warning signal and the stepping signal is produced. When the proper head cartridge is discriminated as having been mounted, the remaining amount detecting operation which is known is performed at proper timing.

The remaining amount detecting sensor of the head cartridge is not limited to the structure described above, but may be as desired in the form or type or in the positions thereof. The same modifications as the first embodiment may be made.

In the foregoing two embodiments, the circuit for detecting the proper mounting of the proper recording head or the head cartridge is constituted using the temperature control system and the ink remaining amount detecting system. However, the detecting circuit may be formed separately. In this case, it may be in the form of a simple wiring pattern or the like for closing a line connecting the control device and the detecting power source in the main assembly, or an electric resistor may be disposed therein. The latter case can meet various types by changing the electric resistance of the resistor.

It is also possible that the two embodiments may be combined. In this case, the recording operation is enabled only when the outputs of the both are proper, by which the discrimination is further assured.

The electric resistance of the ink is different depending on the temperature of the recording head and depending on the remaining amount of the ink. Therefore, if the properness of the recording head is discriminated using the ink remaining amount detecting system, it is desirable that the difference of the electric resistance of the ink is taken into account when the discrimination is desired to be more correct.

Figure 10:
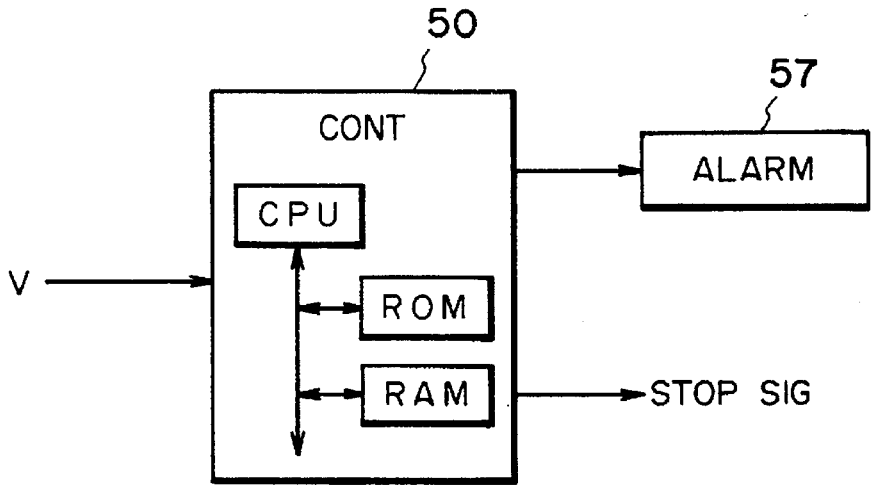
FIG. 10 is a block diagram of a control system for detecting the remaining amount and for discriminating the properness of the ink.

Referring to FIG. 10, a further embodiment of the present invention in consideration of the above will be described. In FIG. 10, the same reference numerals as in FIG. 4 are assigned to the elements having the corresponding functions.

In the ROM of the control device 50, a reference voltage Vr is stored which is the voltage to be provided by the remaining amount detector shown in FIG. 6 when an amplitude of the ink is within the ink container 102.

The warning device 57 may be in the form of a display such as LED or a sound generator such as a buzzer, or a combination thereof. The voltage V is the remaining amount detecting voltage detected by the remaining amount detector. Designated by a reference S is a stop signal for stopping various parts which is produced when improper ink is detected or when the shortage of the remaining amount of the ink is detected.

Figure 11:
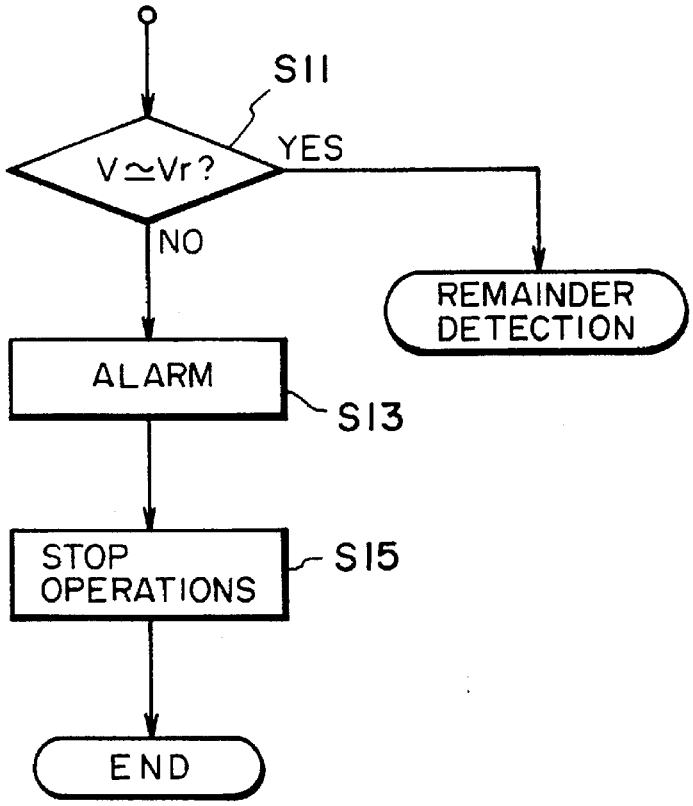
FIG. 11 is a flow chart illustrating the operation using the control system of FIG. 10.

FIG. 11 is an example of the processing steps in the above-described control system, and it may be started when, for example, the exchange of the head cartridge 14 is detected.

When this process is started, the comparison is first made between the voltage V and the reference voltage Vr at step S11. When the result of the comparison indicates that the voltage V is equal to the voltage Vr or that it is within a tolerable range, this operation is stopped. Thereafter, a known remaining amount detecting operation is performed at proper timing. If the shortage of the remaining amount is detected, the warning and stopping operations are performed to inform the operator of the necessity of the head cartridge exchange.

When, on the other hand, the non-equality between the voltage V and the voltage Vr is detected at step S11, use of improper ink is discriminated, in response to which the warning signal is produced at step S13, and the stopping signal for stopping various parts is produced at step S15. Thus, when the ink in the ink container 102 does not match the conditions (ejection outlet diameter, the dimension of the liquid passage and/or the like) of the recording head for some reason or another, or when a head cartridge containing the ink which does not match the various conditions of the main apparatus (driving energy or the like), the event is detected prior to the start of the recording operation, and a warning signal is produced. Therefore, the inconveniences such as the degrading of the record or the head clogging can be prevented from occurring, beforehand.

In the case of the structure wherein the remaining amount of the ink is continuously detected using the characteristics shown in FIG. 9, the voltage V detected is different depending on the level of the remaining amount even if the material of the ink is the same. Therefore, the above discriminating steps are desirably performed under the condition that the ample amount of ink is remaining, and therefore, the voltage V detected is substantially constant. However, in the case of the structure wherein the electrodes are completely immersed in the liquid as long as the ink is remaining to simply detect the presence or absence of the remaining ink, the above steps can be started at any time.

The foregoing description has been made with respect to the liquid jet recording apparatus using a head cartridge containing the recording head chip and the ink container as a unit. However, they may be separate, and the portion of the recording head chip may be non-disposable. In this case, the ink container may be disposed at any portion of the apparatus. When the cartridge is not disposable, the ink may be supplied by injection or the like.

The above will be described in further detail. A main assembly of the apparatus is taken as an example which is an ink jet recording apparatus wherein the proper driving conditions are defined when a predetermined ink is used which shows under a normal condition the voltage of 2.7 V when the detecting current Io is 5 micro-amperes (that is, the electric resistance is 540 K-ohm).

When the ink jet recording apparatus is loaded with a new (not yet used) recording head containing an amplitude of the ink, the electric connection is established between the remaining amount detecting element (detecting means) of the recording head and a remaining amount detection signal receiving circuit of the ink jet recording apparatus, and therefore, a remaining amount detecting circuit and a virtual ink resistance detecting circuit using this circuit are constituted. When the completion of the latter circuit is detected upon this mounting, and the electric current Io (5 micro-amperes) for the ink resistance detection is applied to the detection electrode, a voltage can be produced as a result of the measurement operation. When the result of the voltage is 2.7 V which is the reference voltage, the ink is discriminated as being proper, so that the recording operation is enabled (stand-by).

If the obtained voltage is 8.2 V, that is, the resistance is 1640 K-ohm even if another recording head is mounted which is new, under normal conditions, the apparatus requires the cartridge (recording head) exchange to enable operation of the cartridge. When the recording operation is carried out with the ink resistance different from the reference level, the driving conditions do not match the recording head, and therefore, some function or functions of the main apparatus can be damaged, or the recording operation becomes improper soon, thus reliability of the apparatus is deteriorated. In this sense, the discrimination is important. When the recording apparatus is used under special conditions, the above embodiments do not work well as the case may be.

Figure 13:
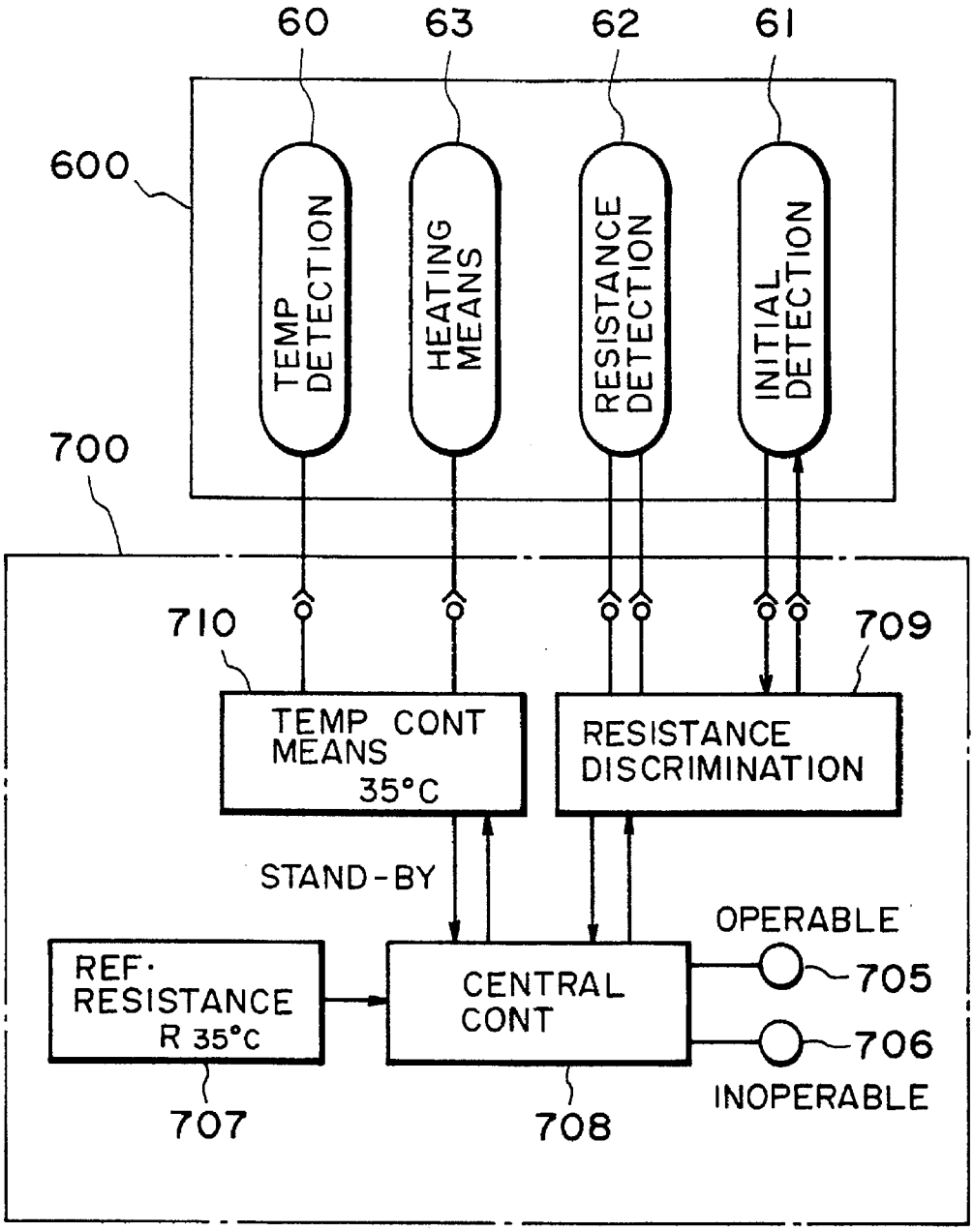
FIG. 13 is a block diagram of a control system for discriminating the properness of the head using the detecting mechanism for detecting the remaining amount of the ink.
Figure 14:
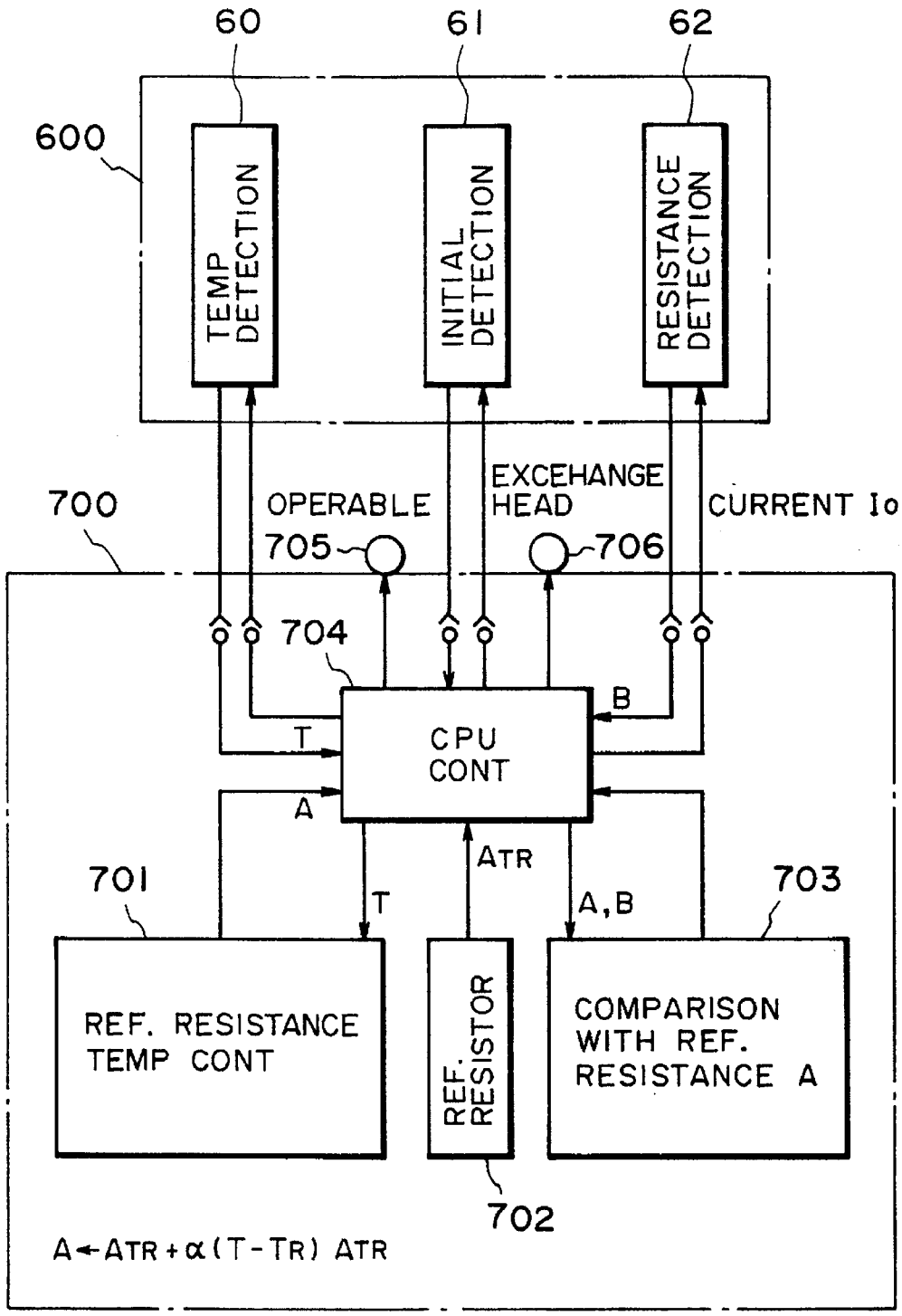
FIG. 14 is a block diagram of a further example of the control system for discriminating the properness of the head using the mechanism for detecting the remaining amount of the ink.

Referring to FIGS. 3, 13 and 14, two embodiments particularly noting the ambient temperature will be described.

In one of these embodiments, a proper temperature of the ink is provided beforehand, and the level at this temperature is stored in the main apparatus as a reference level, and the discrimination is made only at the time when a new cartridge is mounted since then the cartridge is full of the ink.

The other embodiment is based on the premise that the ink resistance changes in accordance with the temperature, and the reference level of the ink resistance is corrected to effect the proper discrimination. On the contrary, the measured level, not the reference level may be corrected, which will be understood from the foregoing description.

In the foregoing examples, the ink detection is performed in the ink container. However, if the ink detection is performed adjacent to the ejection energy generating element, the discrimination of the ink may become further assured.

Figure 12:
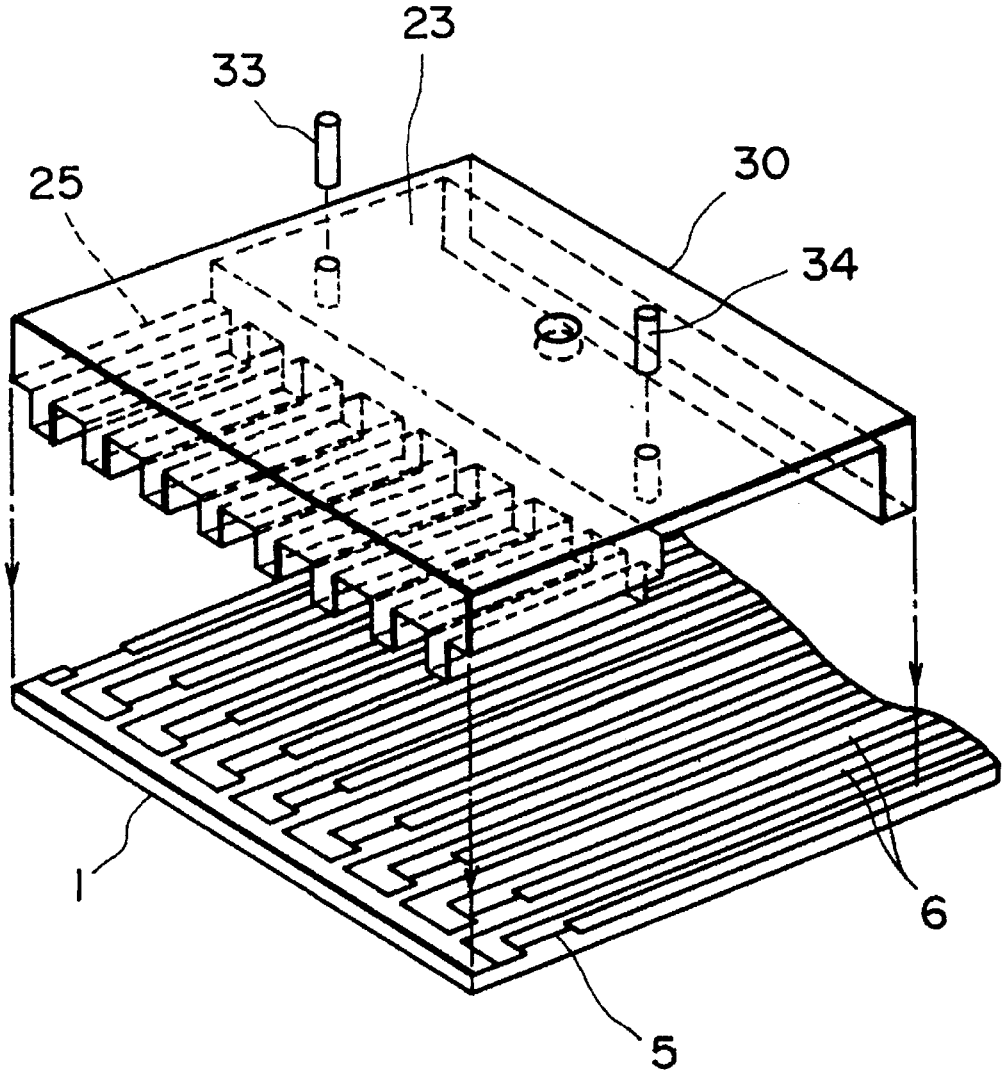
FIG. 12 is a perspective view of another example of the recording head wherein the properness of the head is discriminated using a mechanism for detecting the remaining amount of the ink.

Referring to FIG. 12, there is shown another embodiment wherein a top plate 30 constituting a liquid chamber 23 for supplying ink and nozzles (ink passage 25) is mounted on the silicon substrate 1 shown in FIG. 3. The top plate 30 is mounted on the silicon substrate 1 by bonding or clamping. In this embodiment, the portion of the top plate 30 constituting the liquid chamber 23 is provided with ink detecting electrodes 33 and 34, between which a constant current flows. On the basis of the potential difference detected, the property of the ink can be determined.

In order to further correctly discriminate the ink, the temperature of the ink is measured by a temperature sensor on the silicon substrate, and the data are stored in the RAM of the main assembly together with the detected voltage across the ink detecting electrodes. Next, the temperature keeping heater is energized for a predetermined period to increase the temperature of the head up to 35° C., for example. Then, the detected voltage data and the head temperature detected are stored in the RAM of the main assembly. The relationship between the ink temperature and the ink resistance is stored in the ROM of the main assembly as a table, beforehand. In the sequential operation described hereinbefore, the discrimination is made as to whether or not the detected ink resistance is within a tolerable range determined in accordance with the temperature, so that the temperature characteristics of the ink are compared, by which the ink can be further correctly discriminated.

FIG. 13 is a block diagram of a control system for the recording head of this embodiment. As will be understood, the control circuit of the main assembly is constituted by the recording head 600 mounted to the main assembly 700. The initial detection 61 of the recording head is performed using a distributor board of the recording head 60 for producing an initial signal. When the cartridge (recording head) is mounted into the main assembly, the current supplied from the main assembly returns to the main assembly through the recording head, by which the generation of the initial signal is discriminated. When the initial signal is detected, a large current flows, by which the distributor opens to disable the initial detection. Therefore, absence of the initial signal means that the head has already been discriminated as being proper, so that it is usable even after it is dismounted.

Then, as described hereinbefore, the temperature detecting element 60, the heating means 63 and the temperature control means 710 function to maintain the predetermined temperature To (35° C. in this example). Then, the properness of the recording head mounted is discriminated by a resistance discriminating circuit 709 which compares the resistance R determined by the resistance detecting means 62 with the reference resistance 707R (35° C.) predetermined for proper ink at the temperature of 35° C. If the result indicates that the head is operable, a display lamp 705 is turned on, and if not, the display lamp 706 is flickered (improper head, exchange is required). In this embodiment, in consideration of the ripple of the temperature adjustment, the tolerable range is R (35° C.)±a few ohm.

FIG. 14 is a block diagram of the latter example. The sequential operations are as shown in FIG. 12. The description of the elements which is the same as in FIG. 13 is omitted by assigning the same reference numerals, for simplicity.

Figure 16:
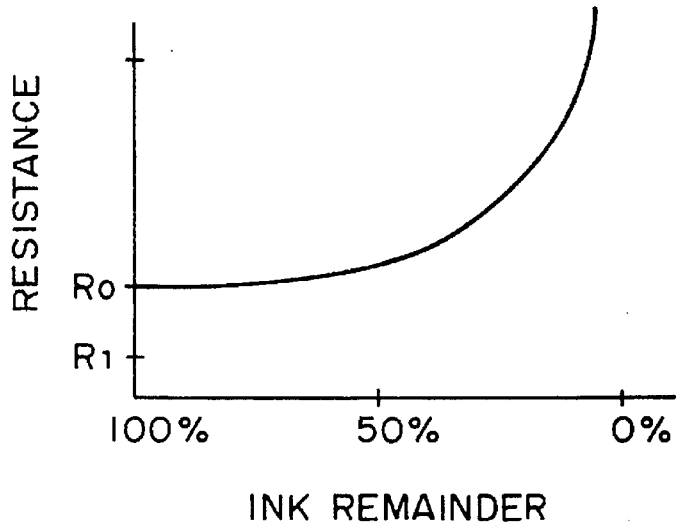
FIG. 16 is a graph showing a relation between the remaining amount of the ink and the resistance of the ink.

The feature of this example is that the variation in the resistance due to the change of the head temperature, that is, the ink temperature is compensated by changing the reference level to increase the discrimination precision. The temperature compensating circuit 701 for the reference resistance functions to process the reference resistance $A_{TR}$ (room temperature $T_R$) with a correcting coefficient $\alpha$ (a correcting parameter corresponding to the resistance change of proper ink), thus, the reference level is changed. On the basis of the temperature T detected, the processing is carried out by $(A_{TR}+\alpha(T-T_R))$, and the value obtained from this equation is compared with the ink resistance B provided by the comparing and discriminating circuit 703. The result is processed similarly to the above. The foregoing example applies to the case wherein the detected ink resistance is close to the proper ink resistance. As shown in FIG. 16, however, the resistance variation range of proper ink may be above the level R0 even if the ambience and the remaining amount of the ink change. In such a case, the above complicated discrimination procedure is not necessary, but the discrimination of improperness is made immediately when a resistance R1 which is smaller than the resistance R0 is detected irrespective of the state of the recording head.

Such a simple discrimination procedure may be contained in the flow chart, or it may be in the form of a separate discriminating means.

In the foregoing examples, the ink remaining amount detecting system is utilized for the discrimination of the properness of the ink, but the discriminating means may be in the form of a separate means.

As described, when improper ink is used, the event is detected, and the recording operation is prohibited. Therefore, the degrading of the record and the clogging of the ejection outlets can be prevented beforehand.

In the foregoing embodiments, the properness of the recording head is discriminated using the temperature sensor. It is possible that the recording head is discriminated by applying a predetermined current to the temperature sensor and detecting the voltage drop.

Figure 17:
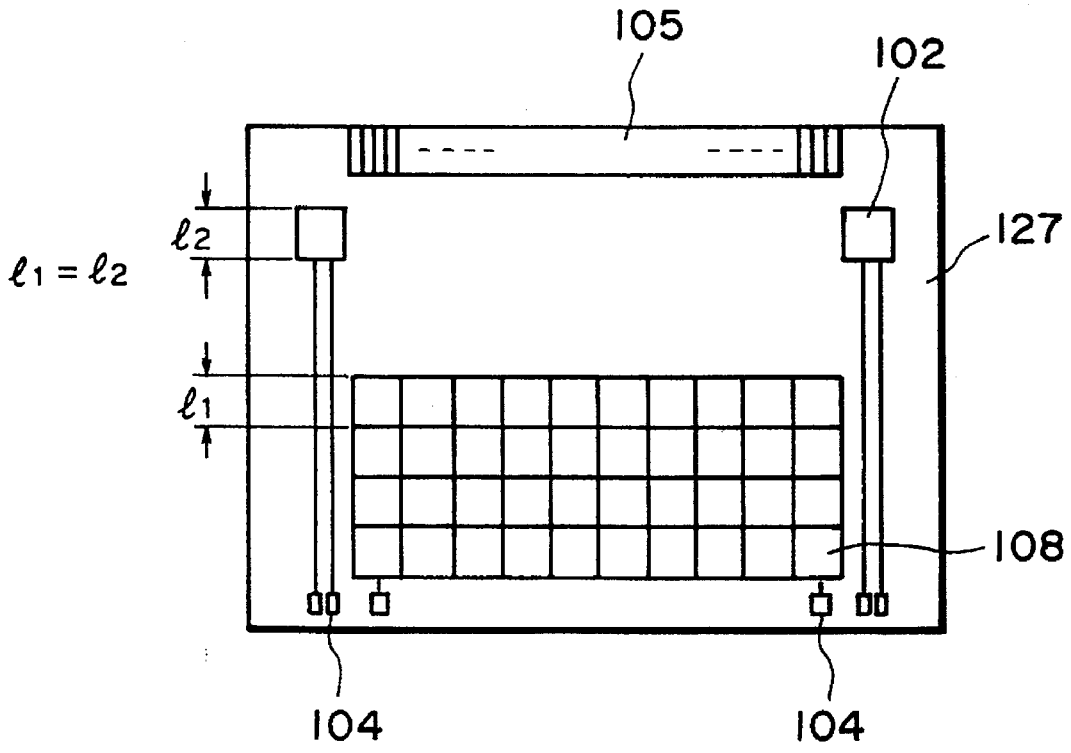
FIG. 17 is a top plan view of another example of the heater board constituting the ink jet recording head shown in FIG. 1 and FIG. 2.

Referring to FIG. 17, the recording head of this type will be described. FIG. 17 shows a top plan view of a heater board constituting the ink jet recording head. The heater board is usable with the structure shown in FIG. 2.

The recording head comprises a heater board 127, ejection heaters (electrothermal transducers) 105 and contacts 104 for external wiring by wire bonding. A temperature sensor 102 detects the temperature of the recording head to control the temperature thereof at a proper level. It includes a diode cell having the same size as the diode cell as the functioning element ($l_1=l_2$ in the Figure) and a group of driving diode cells including functioning diode elements having the same size as the temperature sensor 102. By the driving diode cells, the ejection heaters 105 are selectively driven in accordance with the image data.

Figure 18A:
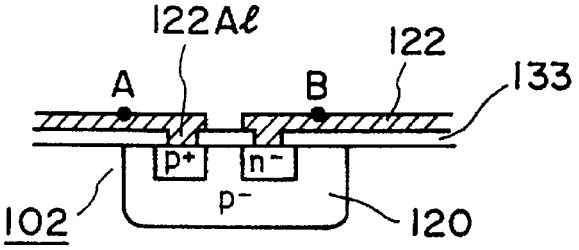
FIG. 18A is a sectional view of a temperature sensor shown in FIG. 17.

As shown in FIG. 18A, a diode 120 of PN-junction is formed on the heater board 127, and the diode property thereof is used for sensing the temperature. Al electrode wires 122 are extended from the p region and the n region of the diode 120, and an insulating layer 133 ($SiO_2$) is formed between the surface of the substrate.

Figure 18B:
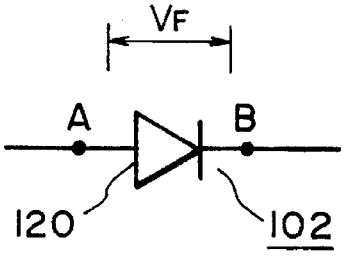
FIG. 18B shows an equivalent electric circuit of the temperature sensor.

FIG. 18B shows an equivalent circuit of the diode shown in FIG. 18A. When the current flows from A side to B side in this Figure, a forward voltage drop VF is produced. Generally, the degree of the forward voltage drop VF changes with the temperature change. Therefore, the temperature is detected using the amount of the change. The forward voltage drop VF also changes with the current density through the diode, and therefore, when a constant current is applied, the forward voltage drop through the diode 120 is a function only of the temperature. In other words, the relation between the forward voltage drop VF and the temperature is:

$$i\ VF=(kT/q)ln(IF/IS) \quad (1)$$

where k and q are constants called number of waves and charge of electron, respectively; IS is a current constant determined from the area of the pn-junction; IF is a forward current; and T is an absolute temperature.

Thus, if the forward current IF through the diode is fixed, the forward voltage drop VF is a function only of the temperature T.

Figure 19:
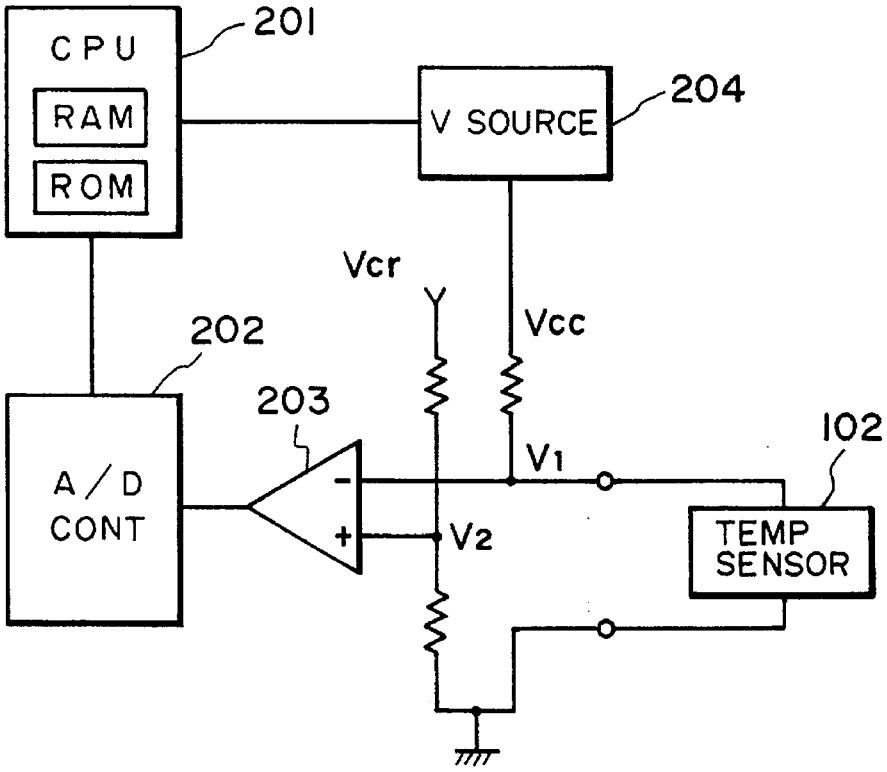
FIG. 19 is a block diagram of the temperature detecting circuit.

FIG. 19 shows a temperature detecting circuit using the temperature sensor 102. The circuit is disposed in the main assembly of the recording apparatus, except for the temperature sensor 102. The circuit is completed by the electric connection closed when the recording head is mounted.

The forward voltage drop VF detected by the temperature sensor 102 appears as the difference between the potential V1 and the reference voltage V2. The potential difference is amplified by the amplifier 203 and is transmitted to CPU 201 through an A/D converter 202 in the form of a digital data. The CPU 201 includes a ROM storing the processing steps for the operation of the ink jet recording apparatus of this embodiment such as the process steps which will be described hereinafter in conjunction with FIG. 20, and RAM usable as a working area for those process steps. Therefore, the CPU 201 also controls the entirety of the recording apparatus such as driving of the ejection heaters in accordance with the recording data or the like. A power source circuit 204 supplies a voltage VCC to the temperature detecting circuit. The power source circuit 204 supplies a constant voltage under the control of the CPU 201 during normal temperature detecting operation. That is, it supplies a constant current to the temperature sensor 102. When, however, the property of the temperature sensor is detected as will be described hereinafter in conjunction with FIG. 20, the supply voltage thereof is changed under the control of the CPU 201.

Figure 20:
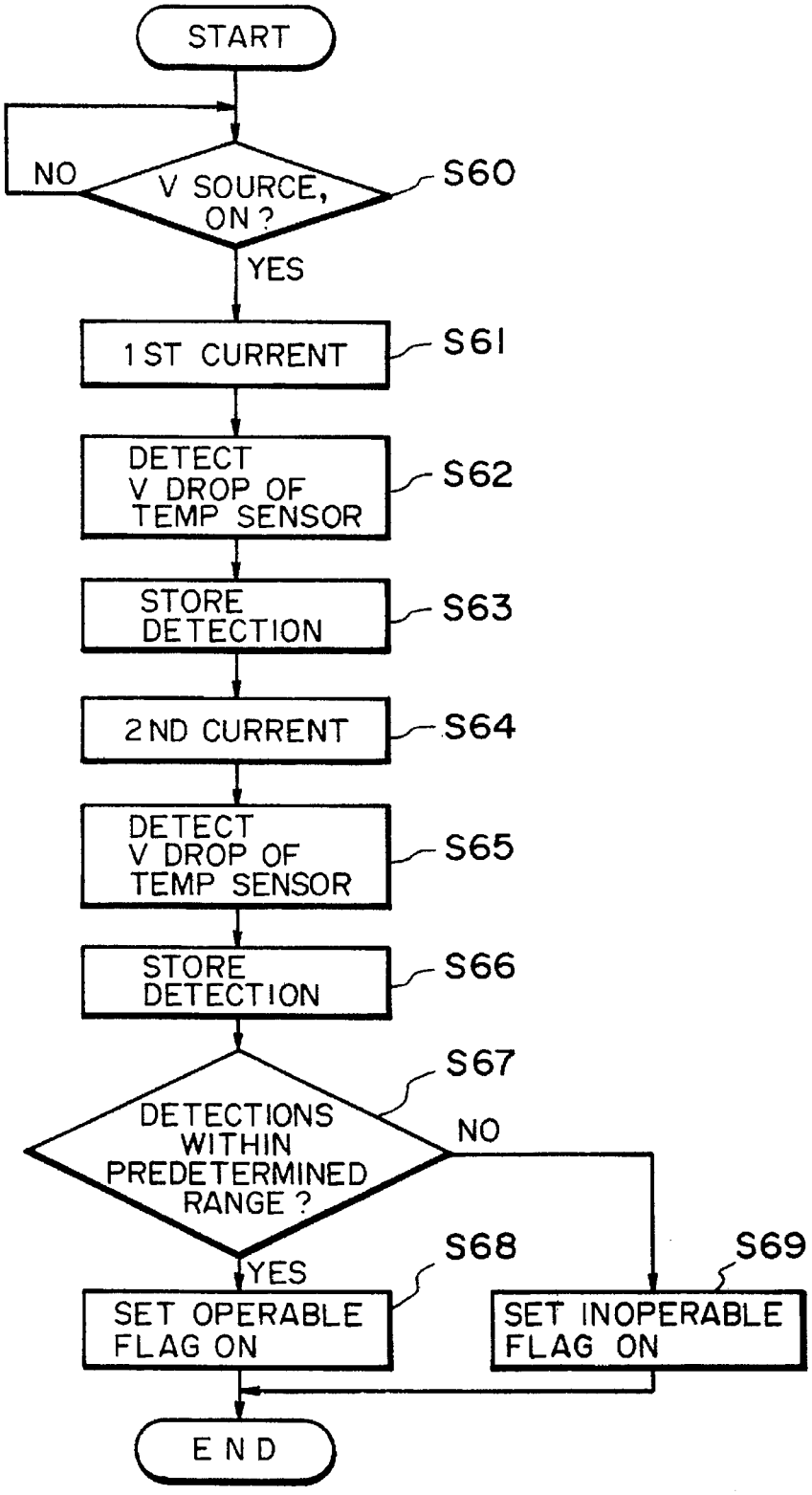
FIG. 20 is a flow chart illustrating the operational steps.

FIG. 20 is a flow chart illustrating the processing steps in this embodiment. This process starts upon the main switch closed, and discriminates whether or not the temperature sensor is proper. At step S60, the actuation of the power source for the recording apparatus is detected, and then, at step S61 the supply voltage VCC is changed to supply to the temperature sensor 102 a first predetermined current, 1 mA, for example. At step S62, the forward voltage drop VF of the temperature sensor 2 is detected, and the voltage drop is stored in the RAM at step S63.

At step S64, similarly to the step S61, the supply voltage VCC is changed to supply to the temperature sensor 102 a second predetermined current, 100 mA, for example. At step S65, the forward voltage drop VF is detected, and the detected voltage drop is stored at step S66.

At step S67, the discrimination is made as to whether the voltage drops stored at the step S63 and the step S66 are both within the respective predetermined range determined by the main assembly. If so, the step S68 is executed by which a flag indicating the "operable" head is set. If not, a flag indicating "non-operable" head is set. This is the end of the process.

As described hereinbefore, the forward voltage drop of the diode constituting the temperature sensor 102 changes depending on the current level with the properties peculiar to the diode. Therefore, the property of the diode constituting the sensor 102 can be detected through the above process steps. In addition, the properness of the recording head provided with the sensor 102 for the main assembly can be discriminated.

It is possible that the property of the diode is determined using only one current level applied to the temperature sensor. However, by using plural levels of the current, the property of the diode can be determined even if the property is non-linear, and therefore, the inspection is further assured.

As described, a predetermined current is applied to the temperature detecting element constituted by the diode, and the voltage drop is detected, by which the operational property of the temperature detecting element is inspected. Depending on the result of the inspection, the properness of the mounted recording head is discriminated.

As a result, the properness of the recording head is discriminated after the recording head is mounted, but before the start of the recording operation, the possibility of the degraded record image or the possible adverse affect to the main assembly attributable to erroneous recording head mounted can be avoided.

As another alternative, it is possible that the properness of the recording head is discriminated by energizing a temperature keeping heater of the recording head for a predetermined period of time after the recording head is mounted and by detecting the temperature change.

Figure 21:
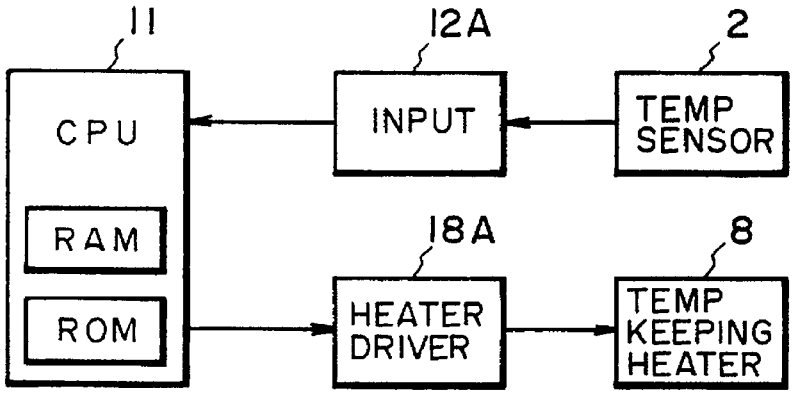
FIG. 21 is a block diagram of a temperature control system, wherein the properness of the head is discriminated using the temperature keeping heater.

Referring to FIG. 21, an embodiment on the basis of this system will be described. In this embodiment, the recording head has the structure shown in FIGS. 2 and 3. FIG. 21 shows a block diagram illustrating the temperature controlling system according to this embodiment. The temperature detecting system is used to control the temperature of the recording head at a proper level.

Various parts connected to the sensor 2 and the heater 8 may be mounted on the control board or the like of the main assembly, and they are connected by contacts 4 and through a wiring 16 (FIG. 1).

A CPU 11 in the form of a microcomputer controls the process steps which will be described in conjunction with FIGS. 22 and 23. The CPU comprises ROM storing fixed data including programs performing the process steps and RAM used as a working area for the process steps. The CPU 11 performs the process steps for inspecting the operational properties of the temperature keeping heater and the temperature sensor, and is also used as the main control system shown in FIG. 2.

An input portion 12A reads the detected level obtained by the energization of the temperature sensor 2 and converts the detected level to a signal matching the CPU 11. A heater driver 18A energizes the temperature keeping heater 8.

Figure 22:
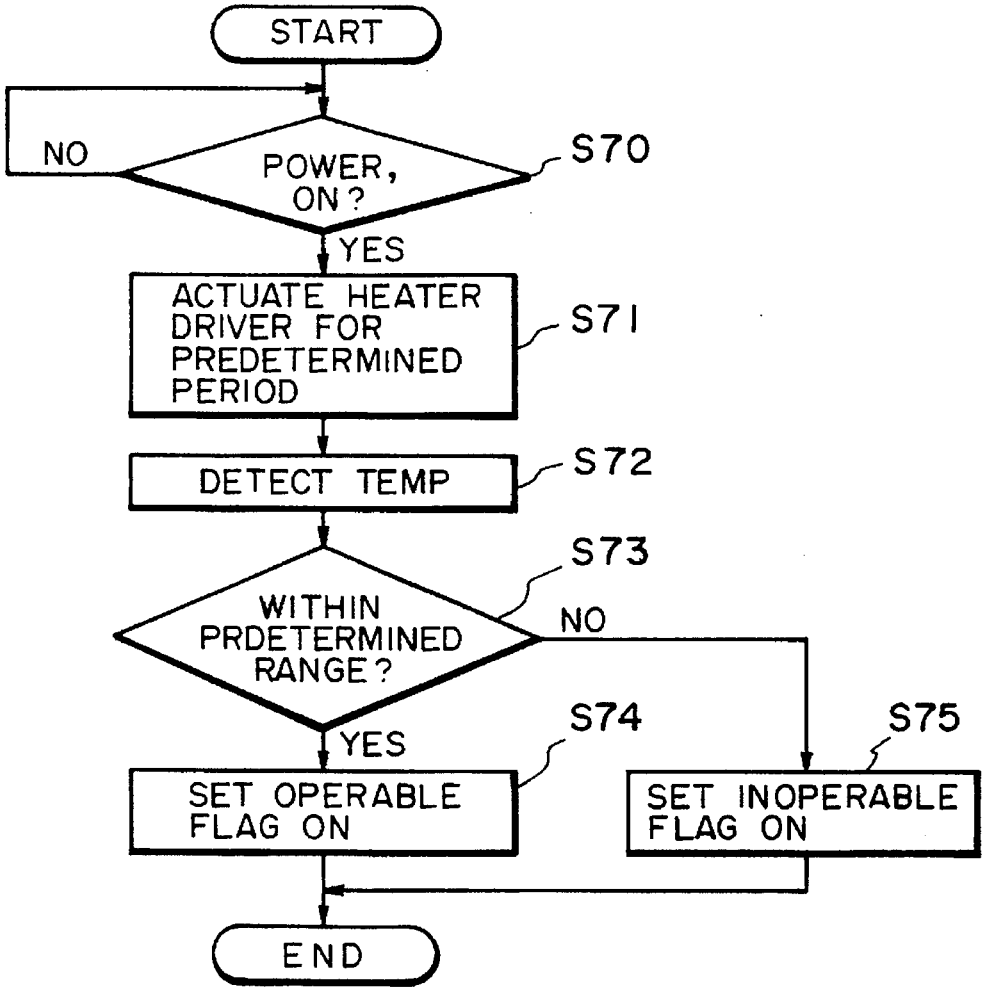
FIGS. 22 and 23 are flow charts illustrating the operational steps to discriminate the properness of the recording head using the temperature keeping heater.

FIG. 22 shows a flow chart illustrating the process steps according to this embodiment. This process starts when the main switch is turned on, and discriminates whether the temperature keeping heater 8 and the temperature sensor 2 are proper.

When the actuation of the main switch of the recording apparatus is detected at step 70, the heater driver 18A is actuated to energize the temperature keeping heater 8 for a predetermined period of time, for example, 10 sec at step 71. Then, at step 72, the detection by the temperature sensor 2 is read. At step 73, the read value is compared with the predetermined temperature range stored in the RAM to discriminate whether it is within the range or not.

If the discrimination at step S73 is affirmative, that is, if the temperature keeping heater 8 and the temperature sensor 2 show proper operational properties, a step S74 is executed to set a "operable" flag. This is the end of this process.

If the result of discrimination at step S73 is negative, the temperature keeping heater 8 or the temperature sensor 2 is deemed improper. Then, at step S75, an "inoperable" flag is set.

Figure 23:
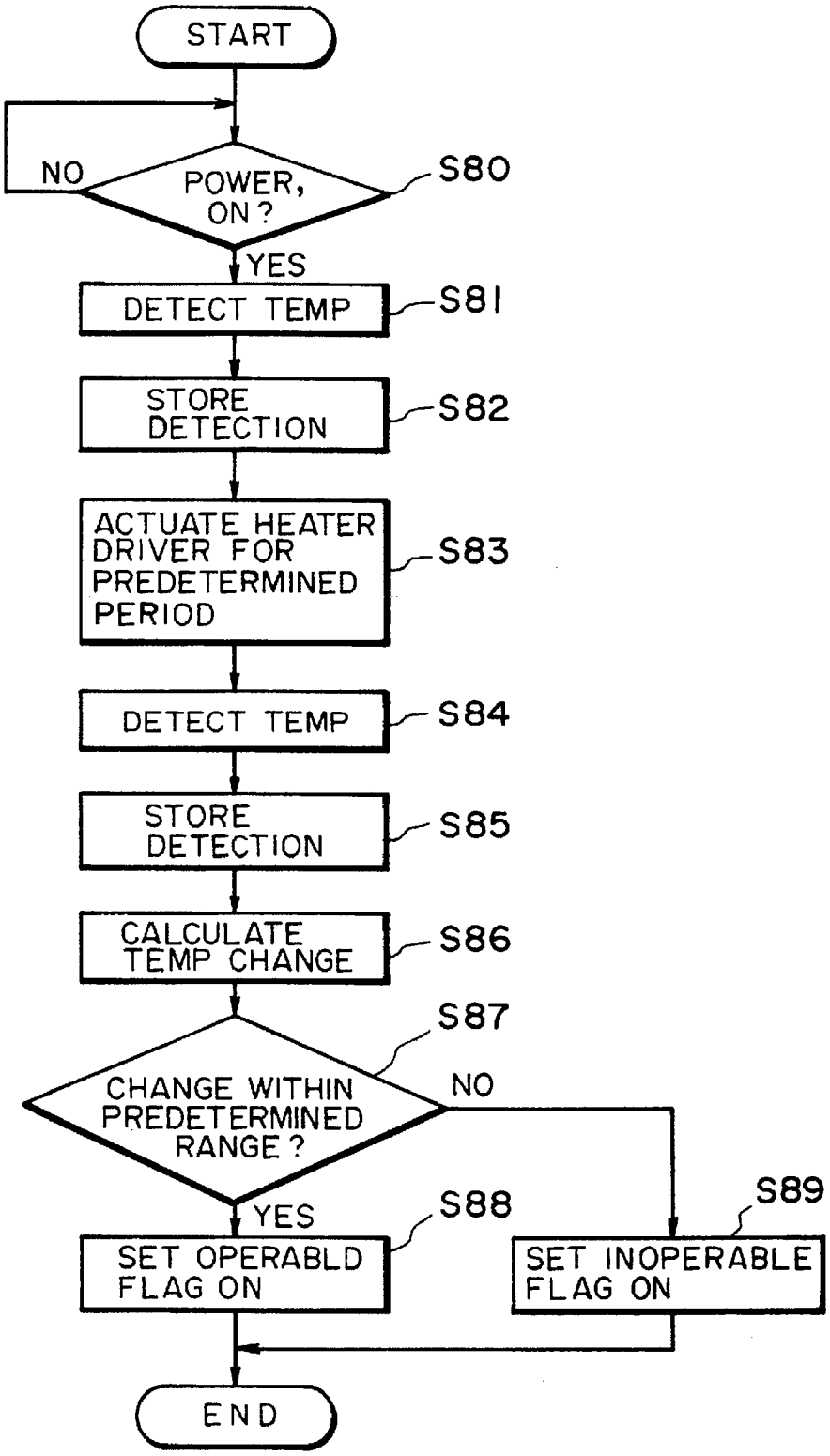

FIG. 23 shows a flow chart of another embodiment for discriminating, similarly to FIG. 22, whether the temperature keeping heater 8 and the temperature sensor 2 are proper or not.

When the actuation of the main switch of the recording apparatus shown in FIG. 2 is detected at step S80, the detection of the temperature sensor 2 read at step S81. This is a first temperature detection. At step S82, the detected level is stored at a predetermined address of the RAM shown in FIG. 24. Thereafter, at step S83, the heater driver 18A is actuated to energize the temperature keeping heater for a predetermined period. After the energization for the predetermined period, the temperature sensor 2 detects the temperature at step S84. This is a second temperature detection. Similarly to the first detection, the detected level is stored in the RAM.

At step S86, the temperature difference is calculated between the first detection and the second detection. At step S87, the discrimination is made as to whether or not the temperature change is within a predetermined range.

Similarly to the process in FIG. 22, the recording operation is enabled or disabled at step S88 or at step S89, in accordance with the discrimination made at step S87. This is the end of this process.

When the recording operation is disabled, the inability may be informed to the operator.

According to the process shown in FIG. 23, the properness of the temperature keeping heater and the temperature sensor is discriminated by the temperature change between two points of time, and therefore, more precise and flexible discrimination than the process of FIG. 22 is possible.

The above process may be performed not only at the time of the actuation of the main switch but also in the period for detecting the mounting of the recording head.

As described in the foregoing, the discrimination is made as to whether or not the temperature keeping heater and the temperature sensor are proper for the main assembly through the process shown in FIG. 22 or 23. The temperature keeping heater or the temperature sensor formed through the process which is similar to the formation of the electrothermal transducer of the ink jet recording head are such elements as remarkably exhibit the property of the recording head containing the temperature keeping heater or the temperature heater. By inspecting the operational properties thereof, the properness of the recording head mounted in the main assembly is discriminated.

The period during which the heater driver is energized in the above process, the predetermined range for discriminating the temperature or the temperature change detected are changed in accordance with the specifications of the head, for example, the number of the electrothermal transducers or the density thereof. When two head cartridges are mounted as shown in FIG. 2, the above process is executed for each of the head cartridges.

In the foregoing embodiment, the temperature sensor is in the form of a thin film resistor. However, this is not limiting. A function element such as diode or transistor is formed on the heater board, and the temperature may be detected using the temperature characteristics of the function element.

Figure 24:
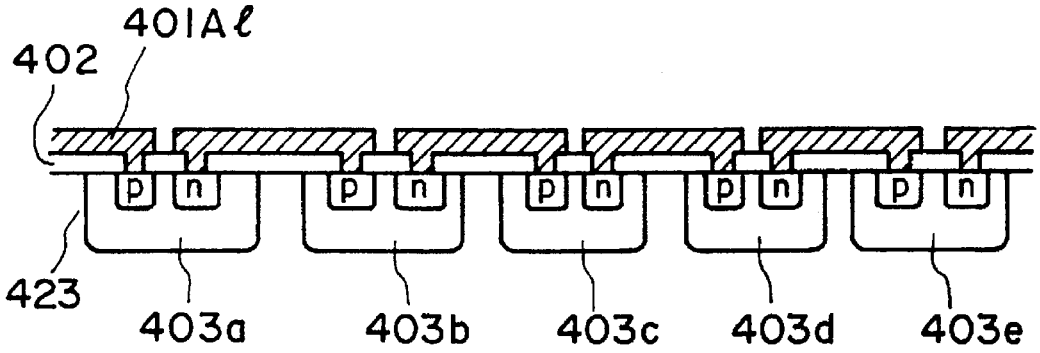
FIG. 24 is a sectional view of a diode array of the temperature detecting element.
Figure 25:
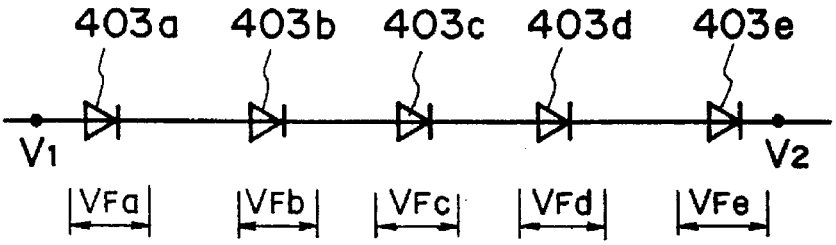
FIG. 25 shows an equivalent circuit of the structure shown in FIG. 24.

Referring to FIGS. 24 and 25 an embodiment of this type will be described.

FIG. 24 is a sectional view of a temperature detecting portion in the recording head according to this embodiment. The temperature detecting portion is constituted by 5 diodes connected in series. Aluminum leads 401 are connected to a p region and an n region of diodes 403*a*–403*c* to connect them in series. An insulating layer 402 made of $SiO_2$ is formed on the top surface of the head base 423 to electrically isolate the electrodes. The 5 diodes 403*a*, 403*b*, 403*c*, 403*d* and 403*e* are connected in series by the aluminum leads 401.

FIG. 25 shows an equivalent circuit of the structure shown in FIG. 24. As shown in this Figure, if the forward voltage drops of the diodes 403*a*, 403*b*, 403*c*, 403*d* and 403*e* are VFa, VFb, VFc, VFd and VFe, the entire forward voltage drop VF=V1−V2=VFa+VFd+VFe.

When the current through the circuit is constant, the forward voltage drop is a function only of the temperature, and the temperature can be detected by detecting the voltage drop.

The operational properties of the temperature keeping heater (heating element) and the temperature sensor (temperature detecting element) are inspected, and the properness of the recording head for the main assembly is discriminated on the basis of the result of the inspection.

When a new recording head is mounted, or when the same recording head is re-mounted, the discrimination is made as to whether or not the recording head is proper for the main assembly before the start of the recording operation, and therefore, the degrading of the image quality or the adverse influence to the main assembly attributable to the erroneous recording head mounted can be prevented.

Figure 26:
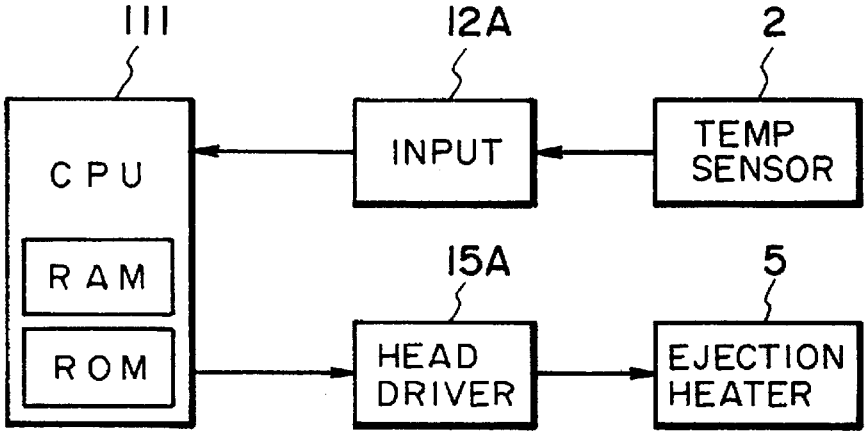
FIG. 26 is a block diagram of a recording head drive control system, wherein the properness of the recording head is discriminated using an ejection heater.

The properness of the head may be discriminated by energizing an ejection heater in a recording head for a predetermined period upon actuation of the main switch or upon mounting of the recording head and detecting the temperature change. Referring to FIG. 26, the description will be made as to an embodiment of this type. The recording head in this embodiment has the structure shown in FIGS. 2 and 3. FIG. 26 is a block diagram illustrating a recording head driving control system and a temperature detecting system. The control system for the recording head drive is used to drive and control the ejection heaters of the recording head in accordance with the record data.

The portions connected to the sensor 2 and the ejection heater 5 may be disposed on the control board or the like of the main assembly, wherein they are connected by contacts through wires 16 (FIG. 1). A CPU is in the form of a microcomputer for executing the process steps which will be described hereinafter in conjunction with FIGS. 27 and 28, and includes ROM storing fixed data such as programs for executing the process steps and RAM used as a working area for the process. The CPU 111 executes the process for inspecting the operation properties of the ejection heater and the temperature sensor in this embodiment. The CPU is also used as a main control system for the apparatus shown in FIG. 2.

An input portion 12A reads the detection upon energization of the temperature sensor 2 and converts the detection to a signal matching the CPU 111. A head driver 15A selectively energizes the ejection heaters 5 in accordance with the data to be recorded.

Figure 27:
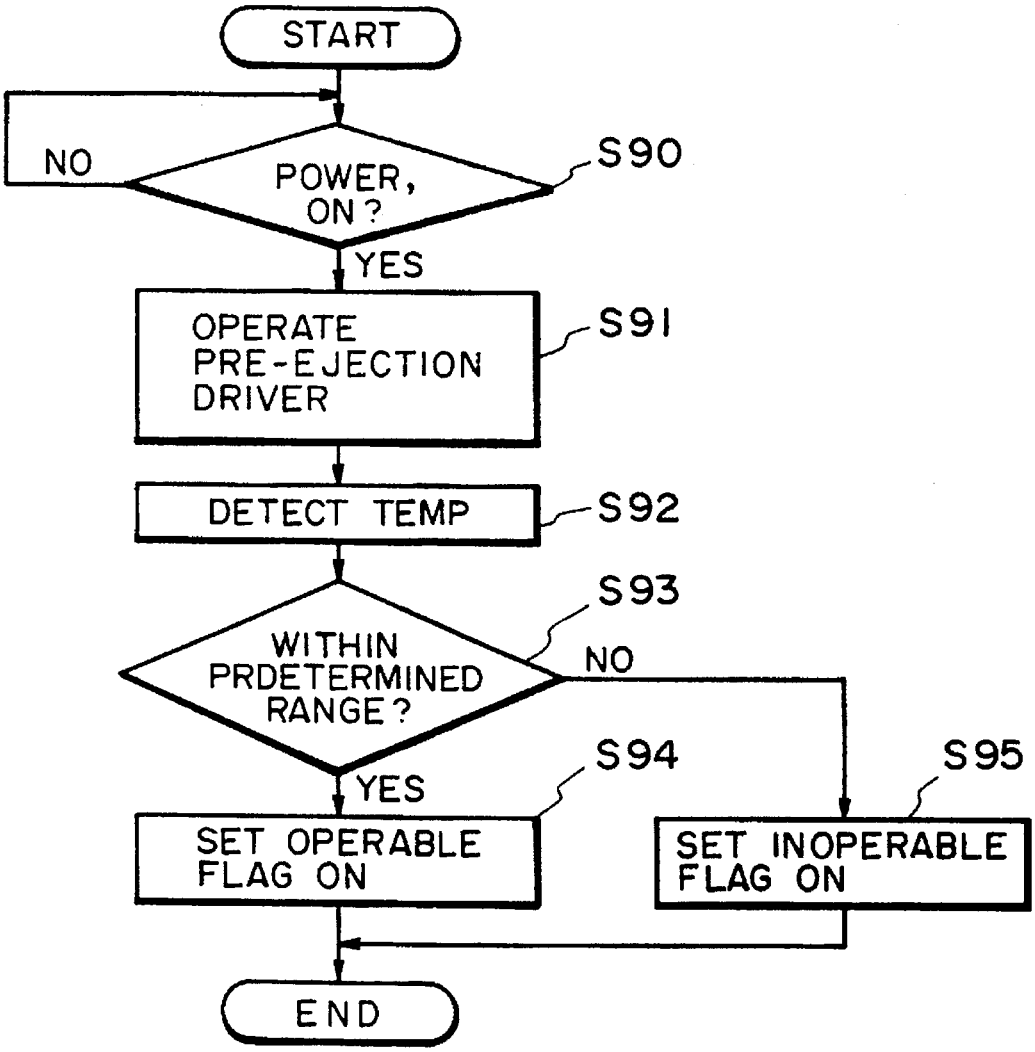
FIGS. 27 and 28 are flow charts illustrating operational steps to discriminate the properness of the recording head using the ejection heater.

FIG. 27 is a flow chart illustrating the process steps according to this embodiment. The process is carried out in connection with the pre-ejection process performed upon actuation of the main switch, and it is to discriminate whether the ejection heater 5 and the temperature sensor 2 are proper or not.

When the actuation of the main switch of the recording apparatus is detected at step S90, the head driver 15A is actuated to energize the ejection heaters 5 for the preliminary ejection, at step S90. At step S92, the detection of the temperature sensor 2 read. At step S93, the read value is stored in the RAM, and it is compared with a predetermined temperature range. Then, it is discriminated whether or not the value is within the predetermined range.

If the result of discrimination at step S93 is affirmative, that is, if the ejection heaters 5 and the temperature sensor 2 show proper operational properties, a step S94 is executed by which "operable" flag is set. This is the end of this process.

If, on the other hand, the result of the discrimination at the step S93 is negative, it is deemed that the ejection heater 5 or the temperature sensor 2 is not proper, upon which "inoperable" flag is set at step S95. This is the end of this process.

Figure 28:
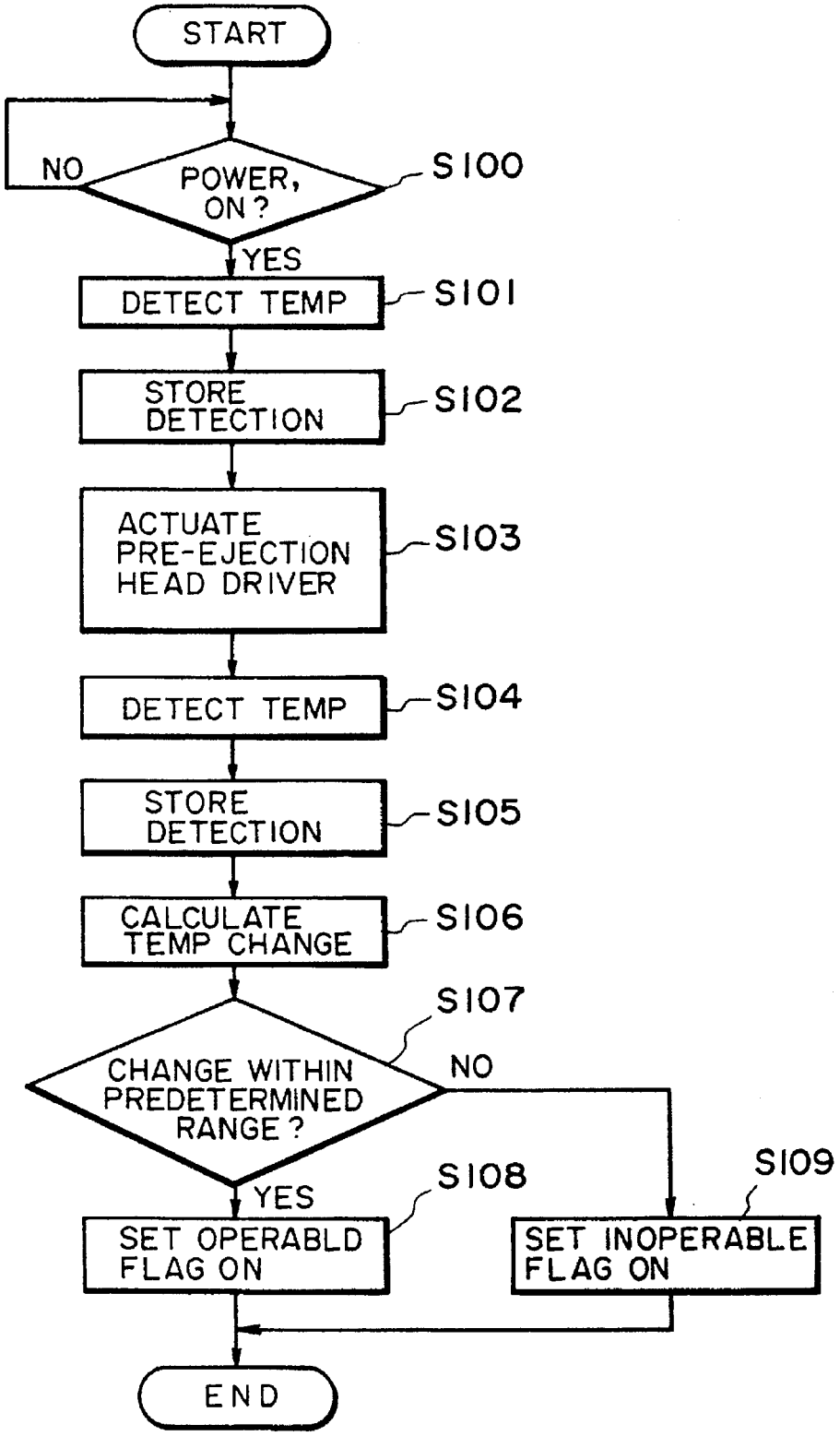

FIG. 28 is a flow chart illustrating the process steps according to a further embodiment. Similarly to the process shown in FIG. 27, this process also discriminates whether or not the ejection heater 5 and the temperature sensor 2 are proper.

When the actuation of the main switch of the recording apparatus shown in FIG. 2 is detected at step S100, the detection by the temperature sensor 2 is read at step S101 prior to the preliminary ejection. This is a first temperature detection. At step S102, the value is stored at a predetermined address of the RAM shown in FIG. 26. Thereafter, at step S103, the head driver 15A is actuated to energize the ejection heaters 5 for the preliminary ejection. After the energization, the second temperature detection by the temperature sensor 2 is carried out at step S104, and the value is stored in the RAM similarly to the first detection.

At step S106, the temperature change between the first detection and the second detection is calculated, at step S107, the discrimination is made as to whether the temperature change is within a predetermined range or not.

Similarly to the process shown in FIG. 27, the recording operation is enabled or disabled at step S108 or at step S109 in accordance with the discrimination at the step S107. This is the end of the process.

When the recording operation is disabled, the inability may be informed to the operator.

The process shown in FIG. 28 discriminates the properness of the ejection heater and the temperature sensor on the basis of the temperature difference between two points of time, and therefore, the discrimination is more precise and flexible than in the process shown in FIG. 27.

As described, by the process shown in FIG. 27 or 28, the properness of the ejection heater and the temperature sensor for the main assembly is discriminated. The electrothermal transducer element or the temperature sensor of an ink jet recording head are such elements that remarkably exhibit the property of the recording head, and therefore, by inspecting the operational properties thereof, the properness of the recording head to the main assembly can be discriminated.

The period during which the head driver is operated for the preliminary ejection, and the predetermined range for discriminating the temperature or the temperature change, in the above process, are changed depending on the specification of the head, for example, the number of the electrothermal transducers or the density thereof. When two head cartridges are mounted as shown in FIG. 2, the above process is executed for each of the head cartridges.

In the foregoing embodiments, the temperature sensor is in the form of a thin film resistor. However, this is not limiting, and a function element such as a diode or a transistor is formed on the heater board as shown in FIGS. 24 and 25, and the temperature may be detected using the temperature depending property of the function element.

In this manner, the operational properties of the ejection heater (electrothermal transducer element) at the temperature sensor (the temperature detecting element) are inspected beforehand. Depending on the results of the inspection, the properness of the recording head for the main assembly is discriminated.

Therefore, when a new recording head is mounted, or when the same recording head is re-mounted, the properness of the recording head for the main assembly is discriminated before the start of the recording operation, and the possible degrading of the image or the possible adverse affect to the main assembly attributable to an erroneous recording head mounted can be prevented.

Figure 29:
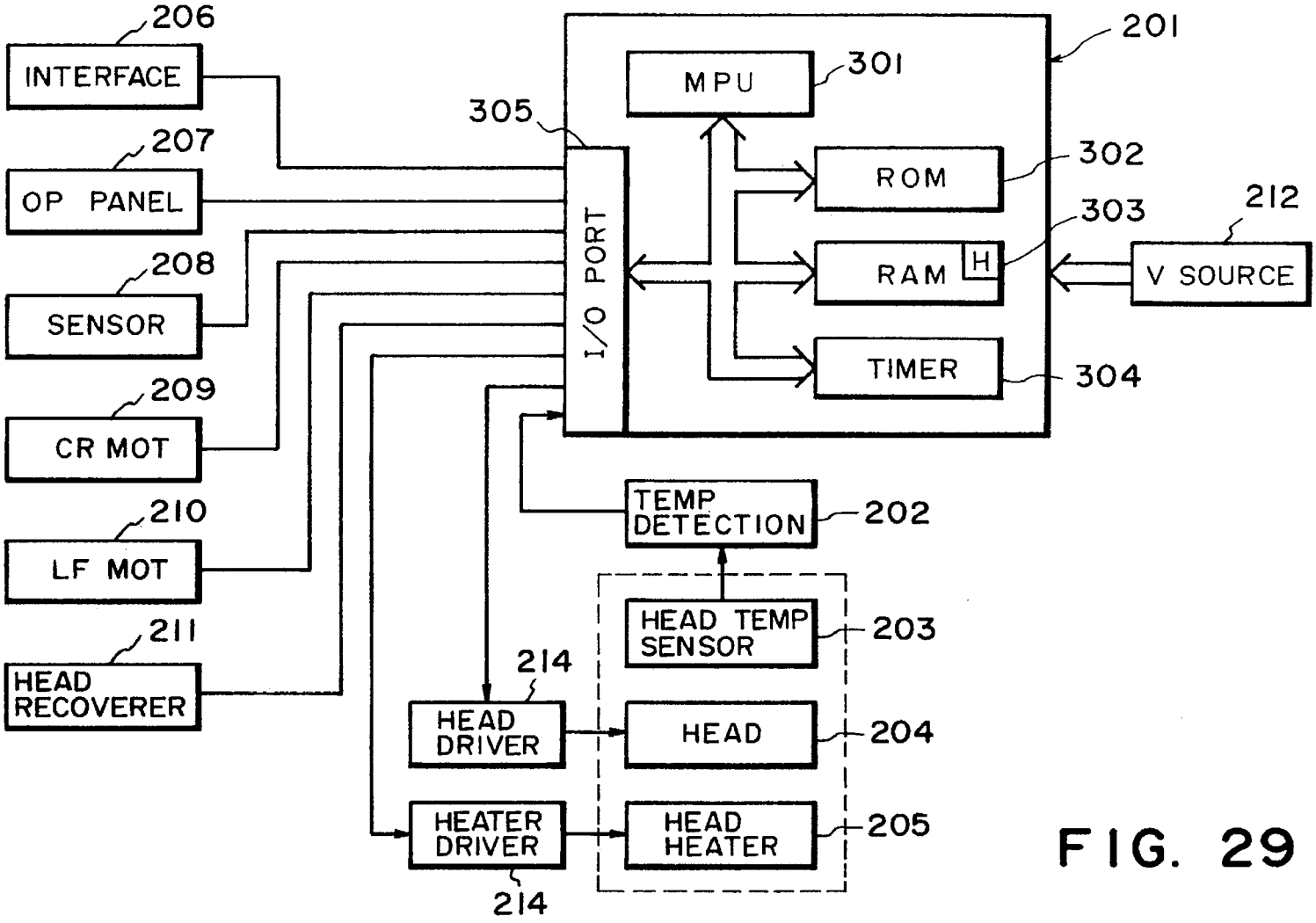
FIG. 29 is a block diagram of a further example of the control system, wherein the properness of the recording head is discriminated using the temperature keeping heater.

In the foregoing embodiment, the temperature is detected after the actuation of the main switch, or the temperature detection is performed twice at a predetermined interval after the mounting of the recording head, wherein the properness of the recording head is discriminated on the temperature detection. A further embodiment will be described wherein the properness of the recording head is discriminated on the basis of the temperature detections before and after the energization of the heater, respectively. Referring to FIG. 29, this embodiment will be described. FIG. 29 is a block diagram illustrating the operation of this embodiment. The recording operation is controlled by a control means 201 which includes MPU 301 containing ROM 302 storing controlling programs for executing the process steps shown in FIG. 30, RAM 303 used for a buffer for the record data or the like, a timer 304 and I/O port 305. The RAM 303 includes a resistor H for storing the detected temperature data when the head heater 205 is not energized and when it is energized.

The temperature of the head 204 is detected by the head temperature detector 203, and the detected temperature is converted to a digital signal by a temperature detecting circuit 202, and the MPU 301 makes discrimination through the I/O port 305. The head heater 205 functions to heat the head 204 when it is low. An interface 206 receives the data to be recorded from host means such as a computer. An operation panel 207 is provided to permit manual control of the recording apparatus. A sensor 208 functions to detect presence or absence of the recording medium. A CR motor 209 serves to move a carriage carrying the head 204. An LF motor 210 feeds the recording medium. A head recovery device 211 is peculiar to an ink jet recording apparatus, and functions to recover the head 204 from clogging or the like. Designated by a reference numeral 212 is a power source for the apparatus. The head is driven by a driving circuit 213, and the heater is driven by a heater driving circuit 214.

Figure 30B:
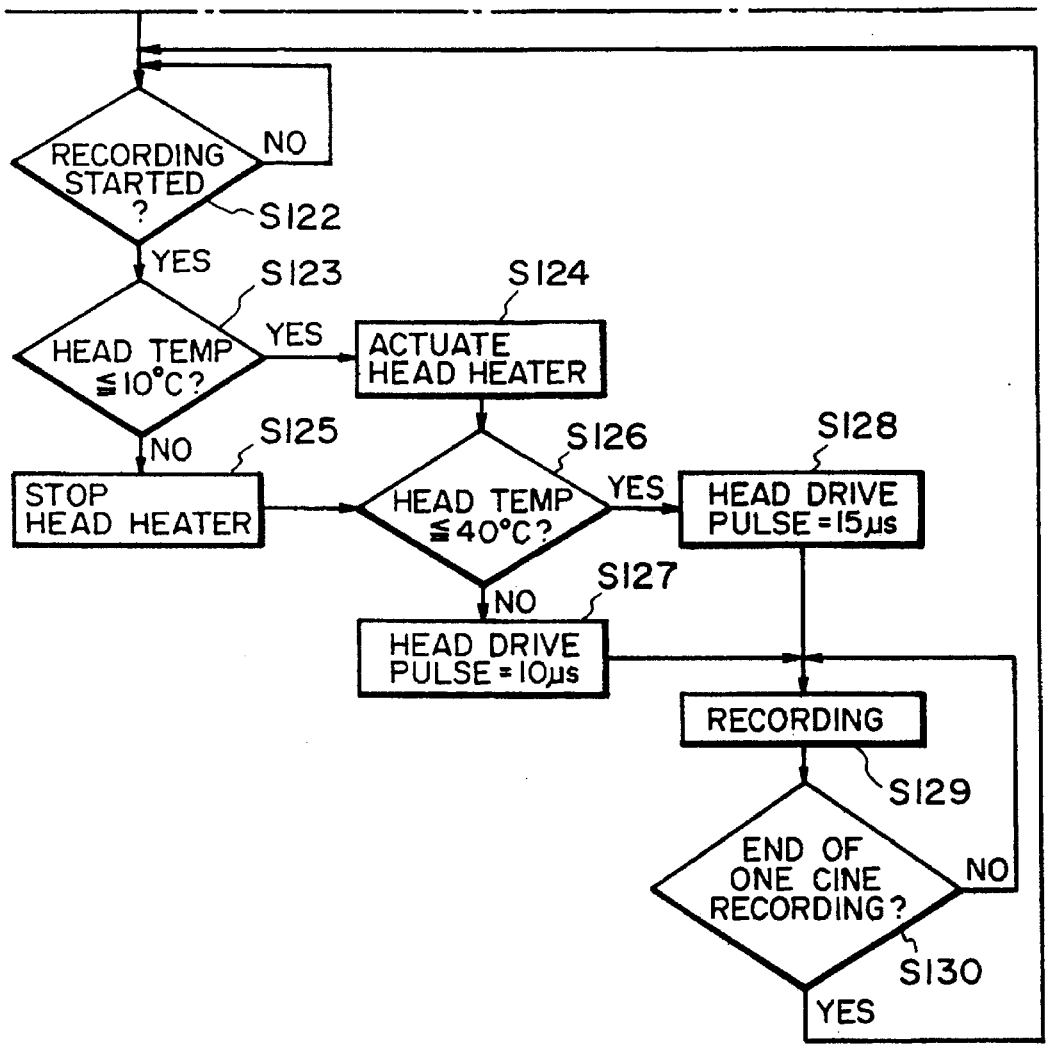

Referring to FIG. 30, an example of the operation of the above structure will be described. When the power switch is actuated at step S112, an initial setting and other initial operations required for the recording are performed at step S113. Then, the temperature (T1) of the head is detected (S114). The head heater is energized (S115), and the timer is started (S116). After 5 sec for example elapses (S117), the temperature T2 of the head is detected again at step S118.

At step S119, the head heater is deenergized, and thereafter, the comparison is made between the head temperatures T1 and T2 which are the temperatures before and after the head heater is energized, at step S120. If $T1 \leqq T2$, the head temperature is not increased despite the energization of the heater, and therefore, it is discriminated that at least one of the head temperature detecting sensor 203, the temperature detecting circuit 202, the head heater 205 and the heater driving circuit 214, fails. Therefore, proper head control can not be performed, and therefore, at step S121, a lamp or the like on the operation panel 207 is turned on to display the occurrence of the error, and the apparatus waits for the inspection without performing the recording operation.

If the above discrimination shows $T2>T1$ at step S120, a step S122 is executed to perform the recording operation.

At step S122, the data to be recorded is transferred to the buffer of the RAM 303 through the interface 206. If the operation panel 207 is on line, the temperature of the head 204 is detected at step S123. If it is not higher than 10° C., the head heater 205 is energized to warm the head 204 at step S124. If it is higher than 10° C., the head heater 205 is deenergized (S125).

Then, if the temperature of the head 204 is higher than 40° C., the driving pulse for the head 204 is set to 10 micro-sec. (S127), and if it is lower than 40° C., the driving pulse is set to 15 micro-sec. (S128).

Then, a step S129 is executed to start the recording. At step S130, the discrimination is made as to whether or not the recording of one line is completed. If so, the sequence goes back to step S122, and it is discriminated whether or not the next line is to be recorded. Thus, the temperature of the head is detected for each line to assure the proper recording.

In FIG. 30, even if the head heater 205 is always energized due to malfunction of the heater driving circuit 214, no error is detected. The apparatus of the next embodiment is such that when the heater driving circuit 214 erroneously operates, and the head heater 205 is energized erroneously, the event is detected.

Figure 31A:
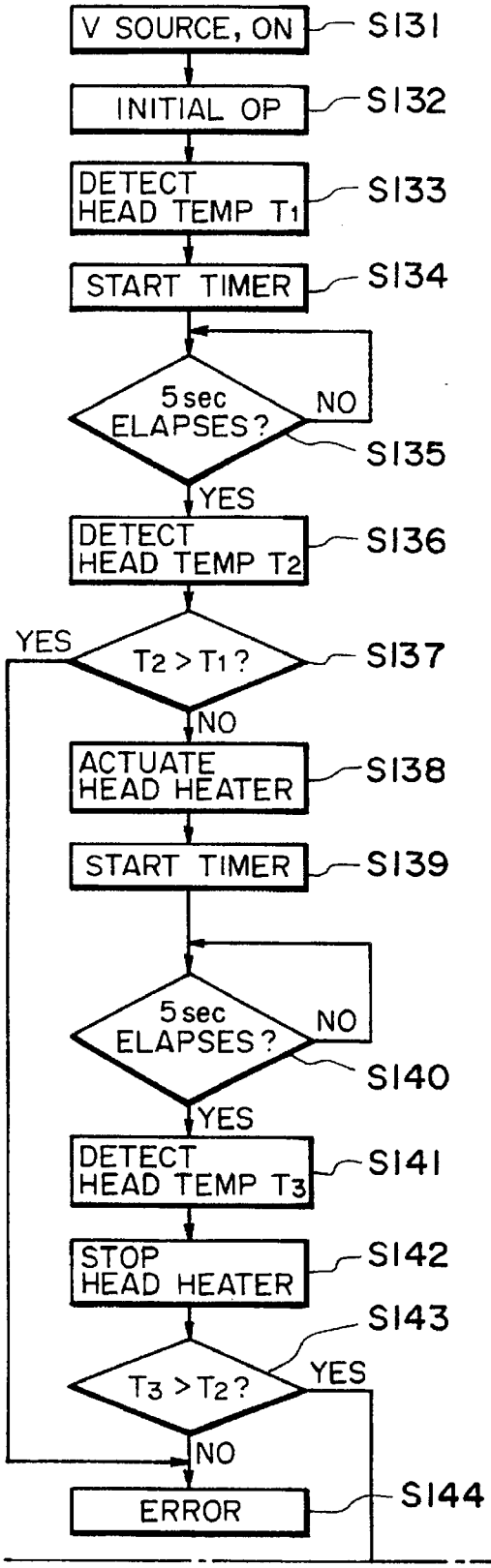
Figure 31:
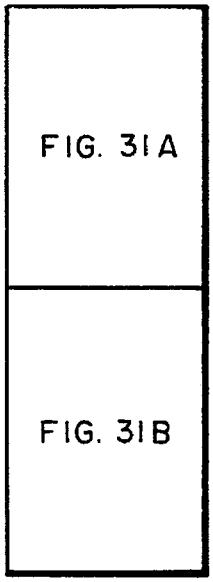
Figure 31B:
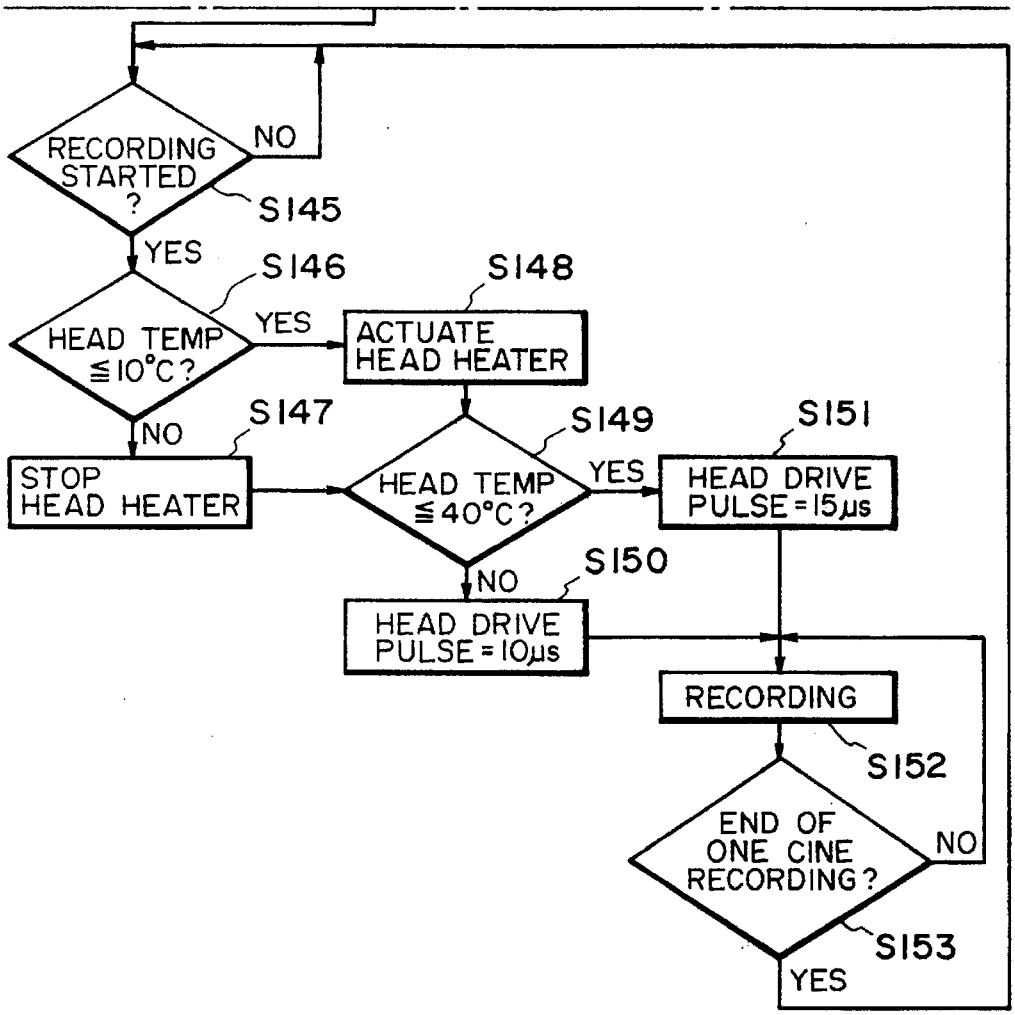

Referring to FIG. 31, the embodiment will be described. When the power switch is turned on at step S131, the initial setting and the initial operating necessary for the recording operation are performed at step S132. Next, the temperature T1 of the head is detected (S133), and the timer is started (S134). After 5 sec, for example, elapses (S135), the temperature T2 of the head is selected again at step S136. Then, the comparison is made between the temperatures T1 and T2 (S137). If $T2>T1$, the temperature of the head is increased despite the heater driving circuit is not actuated, and therefore at least one of the head temperature detecting sensor 203, the temperature detecting circuit 202 and the heater driving circuit 214 operates erroneously. On this occasion, the proper head control can not be performed, and therefore, a step S144 is executed to turn on the lamp or the like on the operation panel 207, and the recording operation is not performed.

If $T2 \leqq T1$ at step S136, a step S138 is executed by which the head heater is actuated. Then, the timer is started (S139). After 5 sec elapses (S140), the temperature T3 of the head is detected again (S41). At step S142, the head heater is deactuated, and then, the comparison is made between the temperatures T2 and T3 which are the temperatures before and after the actuation of the head heater (S143). If $T3 \leqq T2$, the temperature of the head is not increased despite the head heater is actuated, and therefore, at least one of the temperature detecting circuit 202, the head temperature detecting sensor 203, the head heater 205 and the heater driving circuit 214 is erroneously operated. Since the head can not be properly controlled, a step S144 is executed by which the lamp or the like on the operation panel 207 is turned on to display the error, and the apparatus does not perform the recording operation and waits for the inspection.

If $T3>T2$ at step S134, the increase of the head temperature is detected when the head heater is actuated, and therefore, both of the head heater and the head temperature detecting system are operated in order. Therefore, a step S145 is executed.

At step S137 the discrimination has been made as to whether or not the head heater is operated erroneously. At this time, it is possible that the temperature detection for the head is erroneous. In view of this, the discrimination is made as to whether or not the temperature of the head is increased when the head heater is actuated, at step S143. If the temperature rise is detected at step S143, the head heater and the head temperature detection are in order.

The properness of the recording head can be discriminated using a semiconductor element for driving the head.

Figure 32:
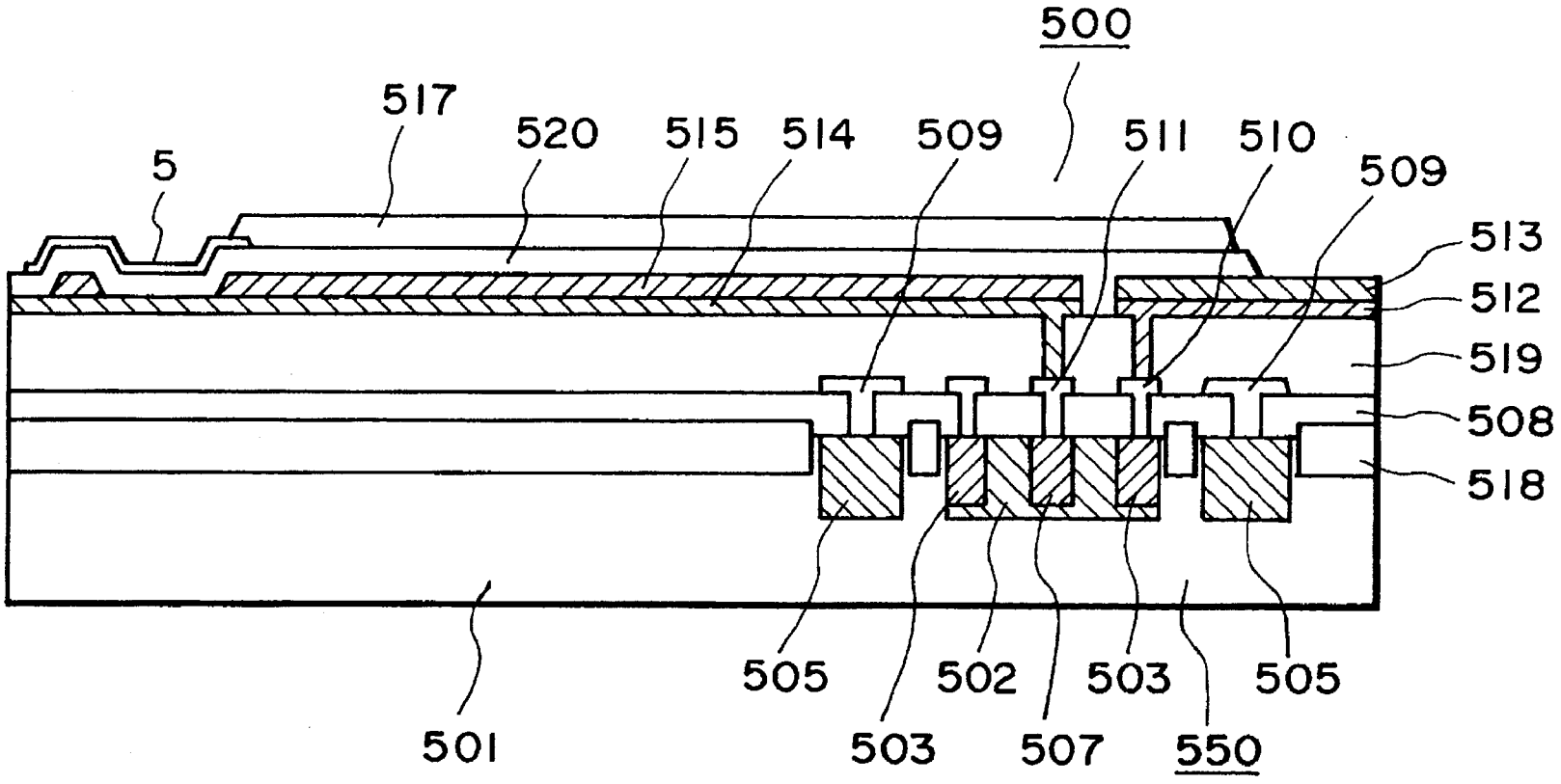
FIG. 32 is a longitudinal sectional view of the heater board.

Referring to FIG. 32, an embodiment of this type will be described. The recording head of this embodiment has a heater board shown in FIG. 3. FIG. 32 shows a longitudinal sectional view of the heater board, wherein an ejection heater 5 and a diode cell 550 of a diode array 500 corresponding to the ejection heater 5 are formed on a common n-type silicon substrate. P well dispersion layer 502 is formed in a part of the n-type silicone substrate 501. Around the p well layer 502, a p+ layer 503 is formed which provides anode electrode 510 of the diode. Also formed on the silicone substrate 501 are n+ layers 507 and 505 provided with a cathode electrode 511 of the diode and a cap electrode 509 for controlling the parasitic transistor operation between the diodes.

The upper part of the diode structure is coated with an insulating layer 508, and to the electrodes 510 and 511, resistor wiring and aluminum wiring 512, 513, 514 and 515 are connected. With the aluminum wiring 515 and the resistor wiring 514, an ejection heater 5 as the heat generating resistor is constituted.

The aluminum electrode 509 on the n+ layer 505 for the cap electrode is disposed to enclose the outer part of the diode, similarly to the n+ layer 505, and is supplied with a cap potential by an external lead. The diode is formed between an anode electrode 510 and a cathode electrode 511. The anode electrode 510 is connected to an external contact of the recording head through the resistor wiring 512 and the aluminum wiring 513. The anode electrode 510 is connected to a common electrode for normally connecting plural anode electrodes depending on the driving system.

Figure 33A:
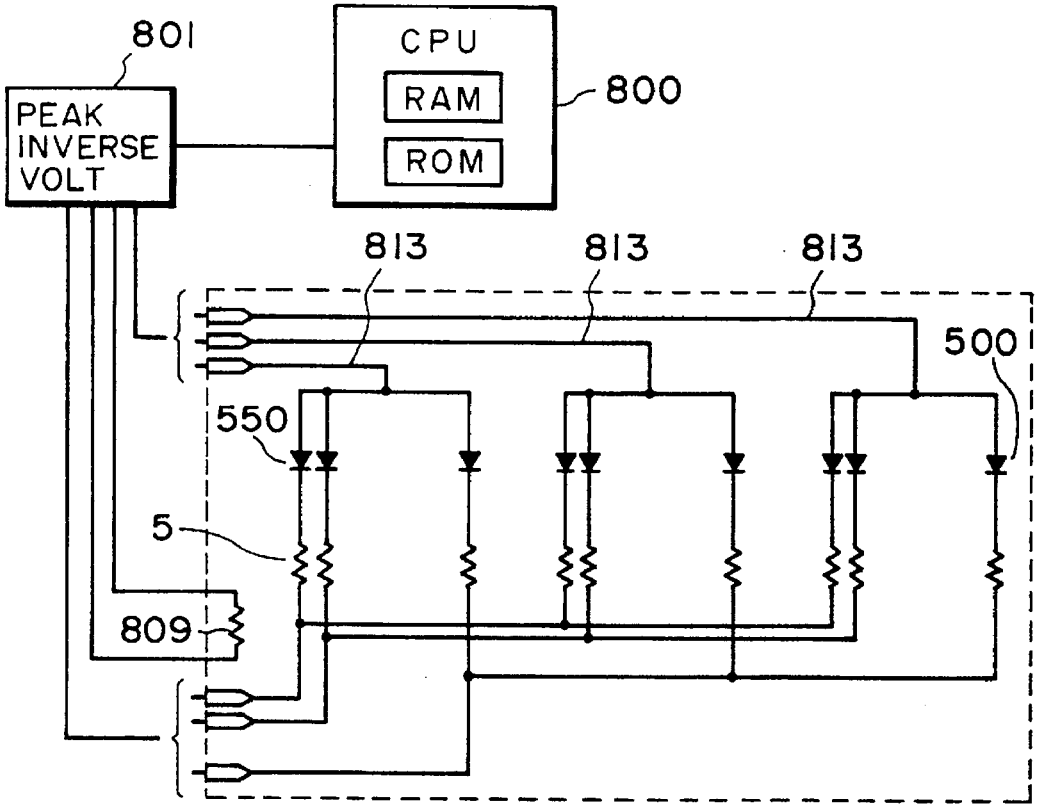
FIGS. 33A and 33B are block diagrams of the recording system, wherein the properness of the recording head is discriminated using a semiconductor function element for driving the recording head.

FIG. 33A shows an equivalent circuit of the heater board shown in FIG. 3 including the ejection heater and the diode array, and shows a circuit block diagram of a peak inverse voltage inspection control system according to this embodiment.

In this Figure, reference numerals 5 and 550 designate the ejection heater and the diode cell. The diode cells 550 constitute a diode array 500. The common electrode wiring 813 is connected to the anode electrode shown in FIG. 32.

A CPU 800 includes a ROM storing the process step, which will be described hereinafter in conjunction with FIG. 34 and RAM used for the working area for the process, to apply the peak inverse voltage to the diode. The CPU 800 also functions to control the entire apparatus. In this Figure, the driving circuit and the signal wiring for driving the ejection heater 5 by the CPU 800 are omitted in this Figure for simplicity. A peak inverse voltage inspection circuit 801 is responsive to the CPU 800 to apply an inspection voltage to the resistance wiring 809, to apply peak inverse voltage to the diode cell 550 and to apply a voltage to inspect the conductivity of the diode cell 550 after the voltage application. The CPU 800 and the inspection circuit 801 are disposed in the main assembly of the recording apparatus.

Figure 34:
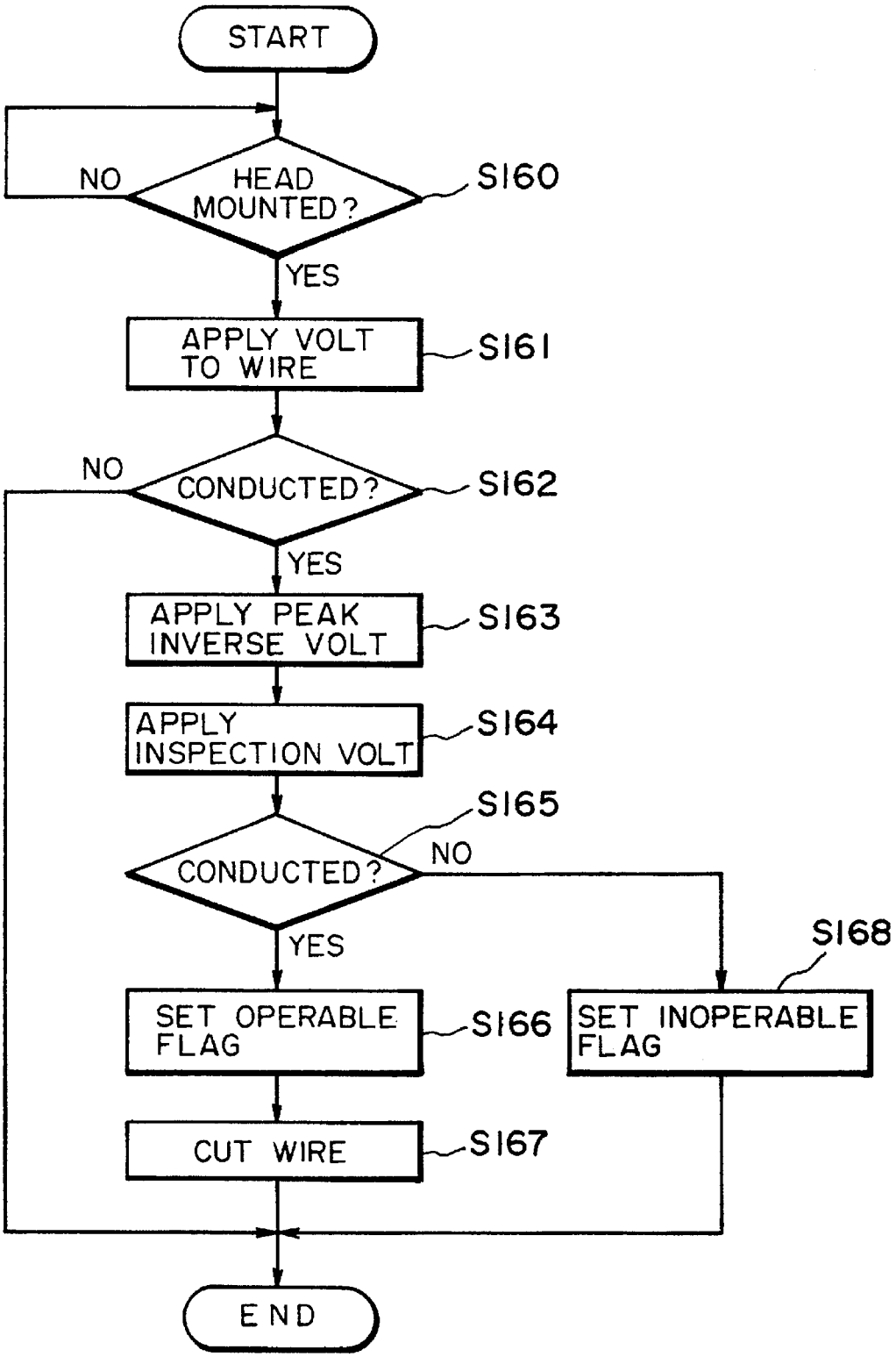
FIG. 34 is a flow chart of the control system of FIGS. 33A and 33B.

FIG. 34 is a flow chart showing the process steps according to this embodiment. This process step is started when the recording head is mounted into the apparatus to inspect the property of the diode for driving the electrothermal transducer.

At step S160, a signal is produced to the CPU 800 in response to a switching action by the mounting of the recording head. When the mounting of the recording head is detected, a step S161 is executed to supply a small current to the resistance wiring 809, and at step S162, the discrimination is made as to whether the wiring 809 is conductive or not.

If not, the process is ended. If it is conductive, a step S163 is executed wherein a predetermined peak inverse voltage is applied to the diode cell 550. The level of the peak inverse voltage is determined by the diode contained in the recording head which is proper to be mounted in the main assembly, and is set to a voltage level smaller than the actual peak inverse voltage. The application of the peak inverse voltage is not necessarily applied to each of the diode cells. It may be applied to one for each common electrode wiring, for example. Next, it step S164, a predetermined forward voltage is applied to the diode cell to which the peak inverse voltage has been applied for the inspection. At step S165, the discrimination is made as to whether or not the diode cell is conductive.

If so, a step S166 is executed, wherein the "operable" flag is set. At step S164, then, the resistance wiring 809 is supplied with the current larger than the tolerable current to fuse it. This is the end of this process. As will be understood from the processing at the step S167 and the discrimination at step S162, the application of the peak inverse voltage is performed only once at the first mounting, and when, for example, the same recording head is mounted again, the peak inverse voltage voltage is not applied. Therefore, the diode is prevented from being deteriorated by too many peak inverse voltage voltage applications.

If the result of discrimination at the step S165 is negative, that is, if the diode cell or the ejection heater is broken to become non-conductive by the application of the peak inverse voltage, the recording head mounted is deemed as improper for the main assembly, and therefore, the "inoperable" flag is set. Simultaneously therewith, audio or visual alarm may be produced.

In the foregoing embodiment, the diode is used for the function element for driving the recording head. However, it is possible that a transistor is used.

Figure 33B:
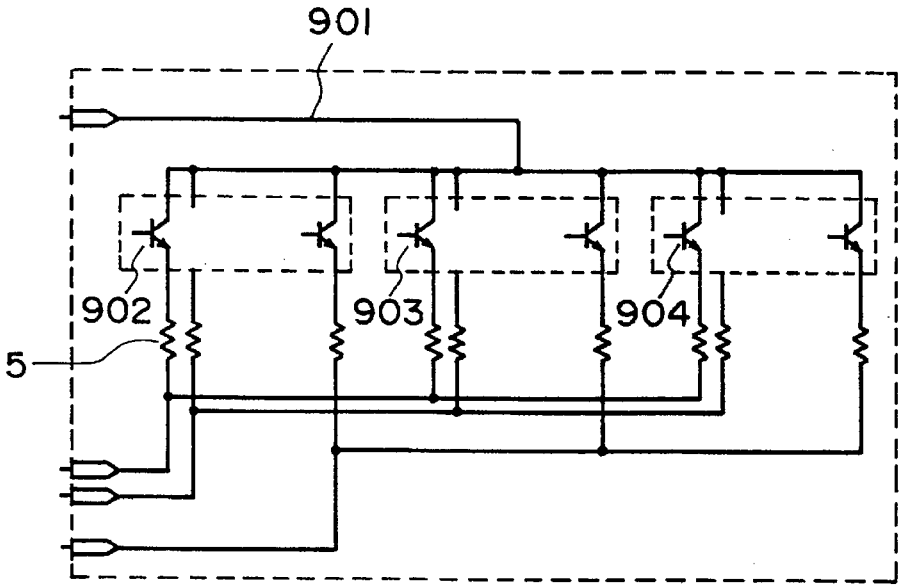

Referring to FIG. 33B, an embodiment of such a type is shown. In this circuit, transistors 902–904 function as switching element for selecting the ejection heaters 5. In this embodiment, the transistor is supplied with the peak inverse voltage to accomplish the above-described function.

The ejection energy generating element is not limited to the ejection heater (electrothermal transducer element), but it may be an element for producing an ejection energy in the form of pressure provided by piezoelectric element or the like.

In this embodiment, when the recording head is first mounted, the predetermined peak inverse voltage is applied in the backward direction. However, this is not limiting. It may be performed each time the main switch is actuated, for example.

According to these embodiments, a predetermined peak inverse voltage which is determined in accordance with the main assembly is applied to the semiconductor function element, and the semiconductor function element is inspected by the application. From the result of the inspection, the properness of the recording head mounted in the main assembly is discriminated.

As a result, the properness of the recording head for the main assembly is discriminated after the recording head is mounted and the recording operation is started. Therefore, the possible degraded record and the possible adverse affect to the main assembly attributable to the mounting of an erroneous head can be prevented.

The foregoing descriptions have been made as to a serial type liquid jet recording apparatus wherein the recording head scans the recording medium. However, the present invention is effectively and easily applicable to a so-called multi-nozzle type apparatus wherein the ejection outlets are arranged covering the entire width of the recording medium.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus to which a recording means is detachably mountable, the recording means being provided with an element for a predetermined function, said recording apparatus comprising:

supporting means for supporting the recording means;

signal transmitting means for transmitting a signal from the element, said signal transmitting means being electrically connected with the element upon mounting of the recording means to said supporting means;

discriminating means for discriminating, upon one of switching on main power of said apparatus and mounting of the recording means to said supporting means, whether the mounted recording means is proper, on the basis of the signal transmitted from said transmitting means; and preventing means for preventing a recording operation when said discriminating means discriminates that the mounted recording means is not proper, wherein the predetermined function is different from the discrimination effected by said discriminating means.

2. An apparatus according to claim 1, wherein the signal is indicative of presence or absence of the element or indicative of a property of the element.

3. An apparatus according to claim 1, wherein said presenting means effects discriminating when said discriminating means discriminates that the mounted recording means is not proper.

4. An apparatus according to claim 2 or 3, wherein the element comprises a temperature sensor for sensing a temperature of the recording means, and said apparatus further comprises temperature control means for controlling the recording means in accordance with an output of the temperature sensor, and the recording means comprises heating means driven in accordance with an output of said temperature control means.

5. An apparatus according to claim 4, wherein said discriminating means discriminates whether the mounted recording means is proper, in accordance with outputs of the temperature sensor when said heating means is on and off.

6. An apparatus according to claim 4, wherein the recording means comprises thermal energy generating means for ejecting the ink, and the energy generating means is driven upon one of switching on of main power of said apparatus and mounting of the recording means to said supporting means.

7. An apparatus according to claim 6, wherein the element generates a signal corresponding to a temperature change resulting from a drive of the energy generating means.

8. An apparatus according to claim 1, wherein said recording means comprises a recording head for ejecting ink droplets in accordance with image data, and ink storing means for storing the ink to be ejected by the recording head.

9. An apparatus according to claim 8, wherein the element generates a signal relating to a remaining quantity of the ink in the ink storing means.

10. An apparatus according to claim 9, wherein the element generates a signal indicative of an electric resistance of the ink stored in the storing means.

11. An apparatus according to claim 9 or 10, wherein said discriminating means compares the signal from the element through said transmitting means with a predetermined value, and on the basis of the comparison, said discriminating means discriminates whether the mounted recording means is proper.

12. An apparatus according to claim 11, wherein said preventing means stops a recording operation, when the signal from the element indicates an insufficient quantity of the ink.

13. An apparatus according to claim 12, wherein the recording means comprises a plurality of ejection energy generating means.

14. An apparatus according to claim 13, wherein the ejection energy generating means comprise electro-thermal transducers, which are effective to eject the ink by causing a change of state of the ink.

15. An apparatus according to claim 9 or 10, wherein said preventing means stops a recording operation, when the signal from the element indicates an insufficient quantity of the ink.

16. An apparatus according to claim 15, wherein the recording means comprises a plurality of ejection energy generating means.

17. An apparatus according to claim 16, wherein the ejection energy generating means comprise electro-thermal transducers, which are effective to eject the ink by causing a change of state of the ink.

18. An apparatus according to claim 1, wherein the recording means comprises ejection energy generating means for ejecting the ink, and the element comprises a semiconductor function element for driving the ejection energy generating means in accordance with image data.

19. An apparatus according to claim 18, wherein upon one of actuation of a main switch and mounting of the recording means to said supporting means, the semiconductor function element is supplied with a predetermined peak inverse voltage, and said discriminating means discriminates whether the mounted recording means is proper in accordance with a state of electric conductivity of the semiconductor function element after the application of the peak inverse voltage.

20. An apparatus according to claim 18 or 19, wherein the ejection energy generating means comprise electro-thermal transducers, which are effective to eject the ink by causing a change of state in the ink.

21. A recording apparatus to which a recording means is detachably mountable, the recording means having an ink ejection outlet, an ejection energy generating element corresponding to the ejection outlet, an ink container for containing ink, and a detecting element for effecting detection relating to a remaining amount of the ink in the ink container, said recording apparatus comprising:

supporting means for supporting the recording means;

signal transmitting means for transmitting a signal from the detecting element, said signal transmitting means being electrically connected with the detecting element upon mounting of the recording means to said supporting means;

control means for controlling a recording operation of the recording means in accordance with a signal through said transmitting means from the detecting element;

discriminating means for discriminating, upon one of switching on of main power of said apparatus and mounting of the recording means to said supporting means, whether the mounted recording means is proper, on the basis of the signal transmitted from said transmitting means; and preventing means for preventing a recording operation when said discriminating means discriminates that the mounted recording means is not proper.

22. An apparatus according to claim 21, wherein the detecting element outputs a signal in accordance with a property of the ink in the ink container, and said discriminating means discriminates that the recording means is proper when the output of the detecting element is within a predetermined range, and discriminates that the recording means is not proper when the output is outside the predetermined range.

23. An apparatus according to claim 22, wherein the detecting element includes a pair of electrodes.

24. An apparatus according to claim 21, wherein said processing means effects a warning in accordance with an output of said discriminating means.

25. An apparatus according to any one of claims 21–24, wherein said energy generating element includes an electrothermal transducer element for producing thermal energy to cause a state change of the ink to eject the ink.

26. A recording apparatus to which a recording means is detachably mountable, the recording means having an ink ejection outlet and an ejection energy generating element corresponding to the ejection outlet, and a temperature detecting element for detecting a temperature relating to the recording means, said recording apparatus comprising:

supporting means for supporting the recording means;

signal transmitting means for transmitting a signal from the temperature detecting element, said signal transmitting means being electrically connected with the temperature detecting element upon mounting of the recording means to said supporting means;

temperature control means for controlling temperature of the recording means in accordance with a signal from the temperature detecting element through said transmitting means;

discriminating means for discriminating, upon one of switching on of main power of said apparatus and mounting of the recording means to said supporting means, whether the mounted recording means is proper, on the basis of the signal transmitted from said transmitting means; and preventing means for preventing a recording operation when said discriminating means discriminates that the mounted recording means is not proper.

27. An apparatus according to claim 26, wherein said preventing means effects a warning in accordance with the output of said discriminating means.

28. An apparatus according to claim 26, wherein said temperature detecting element and said energy generating element are formed on the same substrate.

29. An apparatus according to claim 28 or 26, further comprising a heating element for heating said recording head and temperature control means responsive to an output of said temperature detecting means to control said heating element to maintain a predetermined temperature of said recording head.

30. An apparatus according to any one of claims 28, 26 and 27, wherein said energy generating element includes an electrothermal transducer element for producing thermal energy to cause a state change of the ink to eject the ink.

* * * * *

UNITED STATES PATENT AND TRADEMARK OFFICE

CERTIFICATE OF CORRECTION

PATENT NO. : 5,638,097

DATED : June 10, 1997

INVENTOR(S) : Yoshiaki TAKAYANAGI, et al.

It is certified that error appears in the above-identified patent and that said Letters Patent is hereby corrected as shown below:

ON THE COVER PAGE:

AT [56] References Cited - FOREIGN PATENT DOCUMENTS:

--0224644 6/1987 European Pat. Off.-- should be inserted.

Figure 15:
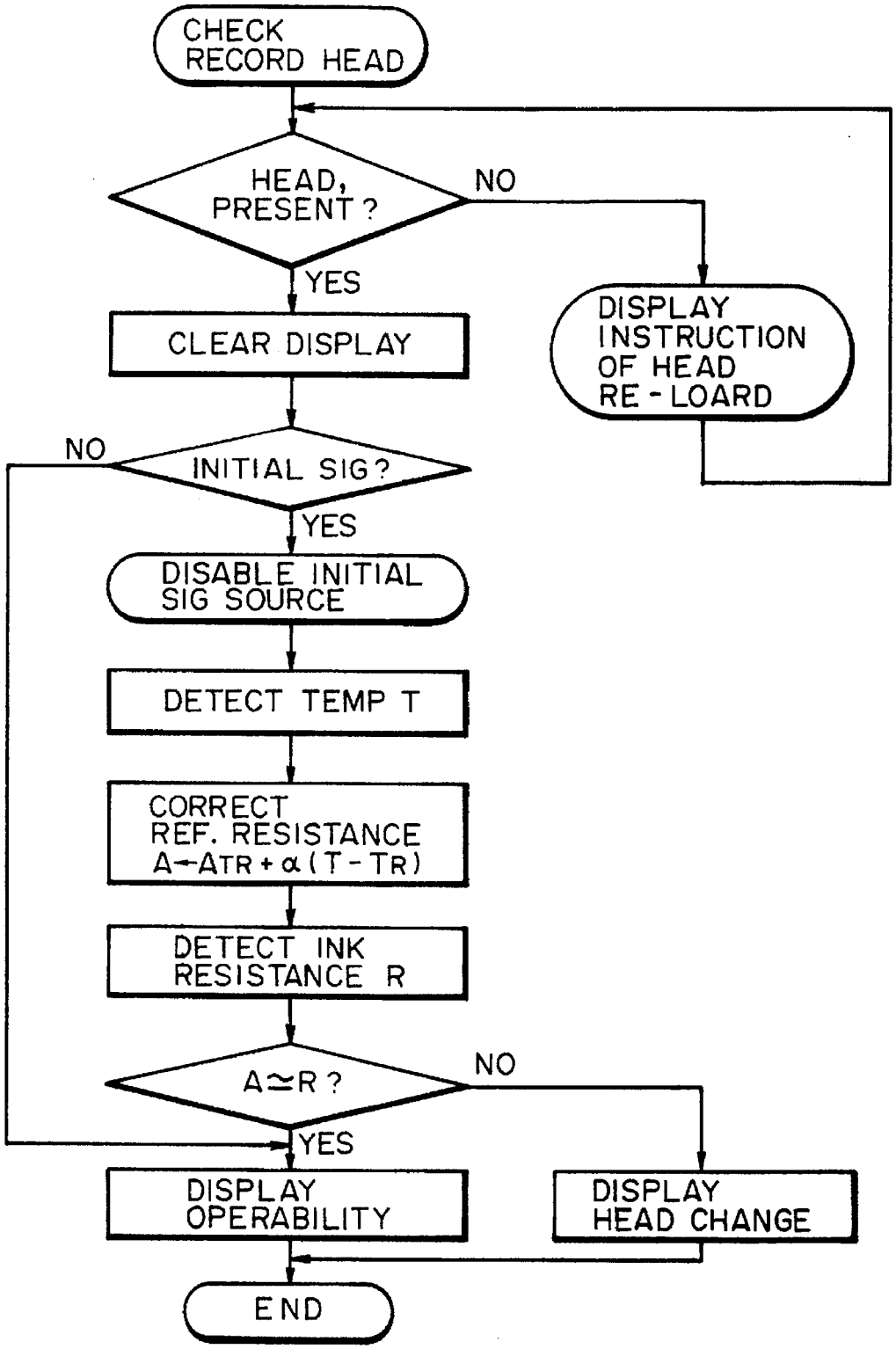
FIG. 15 is a flow chart illustrating operation of the system of FIG. 14.

IN THE DRAWINGS:

Sheet 10 of 26:

Figure 15, "RE-LOARD" should read --RELOAD--.

Sheet 15 of 26:

Figure 23, Step S88, "OPERABLD" should read --OPERABLE--.

Sheet 18 of 26:

Figure 28, Step S108, "OPERABLD" should read --OPERABLE--.

UNITED STATES PATENT AND TRADEMARK OFFICE

CERTIFICATE OF CORRECTION

PATENT NO. : 5,638,097

DATED : June 10, 1997

INVENTOR(S) : Yoshiaki TAKAYANAGI, et al.

It is certified that error appears in the above-identified patent and that said Letters Patent is hereby corrected as shown below:

COLUMN 6:

Line 4, "This" should read --These--.

COLUMN 7:

Line 48, "is" should read --are--.

COLUMN 8:

Line 3, "the" (second occurrence) should be deleted.

COLUMN 10:

Line 56, "ohm." should read --ohms.--.

COLUMN 12:

Line 1, "i" should be deleted.

COLUMN 14:

Line 3, "read" should read --is read--;

UNITED STATES PATENT AND TRADEMARK OFFICE

CERTIFICATE OF CORRECTION

PATENT NO. : 5,638,097

DATED : June 10, 1997

INVENTOR(S) : Yoshiaki TAKAYANAGI, et al.

It is certified that error appears in the above-identified patent and that said Letters Patent is hereby corrected as shown below:

Line 61, "diodes 403*a*-403*c*" should read --diodes 403*a*-403*e*--.

COLUMN 18:

Line 31, "is not" should read --not being--.

COLUMN 21:

Line 32, "presenting" should read --preventing-- and "discriminating" should read --a warning--.

COLUMN 23:

Line 12, "processing" should read --preventing--.

Signed and Sealed this

Seventeenth Day of February, 1998

*Attest:*

*Attesting Officer*

Bruce Lehman

BRUCE LEHMAN

*Commissioner of Patents and Trademarks*